US008037897B2

(12) United States Patent
McIntire

(10) Patent No.: US 8,037,897 B2
(45) Date of Patent: Oct. 18, 2011

(54) VALVE APPARATUS

(76) Inventor: William Ray McIntire, Sugar Land, TX (US)

( * ) Notice: Subject to any disclaimer, the term of this patent is extended or adjusted under 35 U.S.C. 154(b) by 714 days.

(21) Appl. No.: 12/214,583

(22) Filed: Jun. 20, 2008

(65) Prior Publication Data

US 2009/0314979 A1 Dec. 24, 2009

(51) Int. Cl.
*F16K 15/00* (2006.01)

(52) U.S. Cl. ..... 137/516.29; 137/902; 251/332

(58) Field of Classification Search ..... 251/332, 251/333; 137/516.27, 516.29, 902
See application file for complete search history.

(56) References Cited

U.S. PATENT DOCUMENTS 2,495,880 A 1/1950 Volpin
3,039,488 A * 6/1962 Bowerman ..... 137/516.29
3,057,372 A * 10/1962 Sutton et al. ..... 137/516.29
4,860,995 A * 8/1989 Rogers ..... 251/356
4,922,957 A * 5/1990 Johnson ..... 137/516.29
4,951,707 A * 8/1990 Johnson ..... 137/516.29
6,701,955 B2 3/2004 McIntire et al.
7,000,632 B2 2/2006 McIntire et al.
7,070,166 B1 * 7/2006 Blume ..... 251/359

* cited by examiner

*Primary Examiner* — John Fristoe, Jr.
(74) *Attorney, Agent, or Firm* — L. Wayne White

(57) ABSTRACT

A valve apparatus that has a longitudinal axis therethrough comprises a valve seat member, a valve closure member, a fluid flow path, and a resilient valve insert member. The valve seat member comprises a hollow bore and a first frustoconical contact surface that has an inner perimeter and an outer perimeter. The valve closure member comprises a valve body and a second frustoconical contact surface that is adapted to seal against the first frustoconical contact surface in a strike face area. The valve closure member is movable along the longitudinal axis of the valve apparatus. The fluid flow path extends through the bore of the valve seat member and between the valve seat member and the valve closure member. This fluid flow path is closed when the second frustoconical contact surface is sealed against the first frustoconical contact surface.

28 Claims, 29 Drawing Sheets

VALVE APPARATUS

RELATED U.S. APPLICATIONS

Not Applicable

FEDERALLY SPONSORED RESEARCH AND DEVELOPMENT

Not Applicable.

FIELD OF THE INVENTION

This invention relates generally to fluid delivery systems and more particularly to valve assemblies that handle (i.e., that are in fluid contact with) particulate-containing fluids at high pressure. Aqueous fracturing fluids containing proppant are examples of such particle-containing fluids.

BACKGROUND OF THE INVENTION

It is common to pump fluids that contain particulates into oil and gas wells. For example, fracturing fluids typically contain proppant particles, such as sand or small ceramic or glass beads, that typically range in size from U.S. Standard Sieve sizes 60 through 16 (0.01 to 0.05 inches, 0.025 to 0.12 cm), and occasionally from U.S. Standard Sieve sizes 100 through 10 (0.006 to 0.079 inches, 0.015 to 0.20 cm). Other fluids containing particles are used for abrasive jetting in oil or gas wells. Slurries (mixtures of liquids and solid particles) are more difficult to pump than particle-free fluids. The presence of solid particles adversely affects pump efficiencies and valve lifetimes, especially at high pressures and/or high flow rates.

Reciprocating plunger pumps are frequently used by oil field service companies to pump proppant-containing fracturing fluids into oil and gas formations. These pumps typically include valve assemblies that are biased toward the closed position. When the motion of the plunger creates fluid flow resulting in a differential pressure across the valve, the differential pressure forces the valve open. However, when the forward motion of the plunger slows and the valve begins to close, solid particles in the fluid can become trapped within the valve assembly. The trapped solids prevent the valve from fully closing and thereby reduce the efficiency of the pump. Trapped solids can also damage the valve assembly components and reduce the useful life of the valve assembly.

The valve assemblies in reciprocating plunger pumps typically contain an area where the metal surface of the valve closure member contacts the metal surface of the valve seat member when the valve is closed. That area is commonly referred to, and is defined herein, as the "strike face area." There is little or no damage done to the metal surfaces of the valve components when only clear fluids (e.g., clear liquids, such as water or gelled aqueous fluids) are pumped through the valve assembly. The valve lifetime can be quite long and may even outlast the fluid end of the pump in endurance test runs when the pumping medium is a clear fluid. However, when the pumping medium is a slurry, such as a fracturing fluid with proppant, the metal contact surfaces in the strike face area are severely damaged by erosion, abrasion and by pitting caused by solid particles in the fluid. If solid particles are trapped between the metal surfaces as the valve closes, the closing force of the valve is applied to the metal surfaces through the particles rather than being spread uniformly across the strike face area. The localized contact forces, Hertzian contact forces, at the interface of the trapped particles and the metal surface cause pitting in the metal surface. The damage caused by trapped particles is extensive. The valve life can be less than an hour under extreme conditions. Attempts to mitigate the damage to the valve assemblies have been made. One such technique involved an attempt to minimize or replace the metal-to-metal contact in the strike face area by including a resilient elastomeric insert in the closure member or the valve seat. While useful, this technique has not been wholly successful. Solid particles are still trapped at the outer perimeter where the resilient insert forms a hydraulic seal as it closes against the metal surface of the valve seat member. Damage to the metal surfaces near to and along that perimeter increases the extrusion gap size that the resilient insert has to span in order to form an effective hydraulic seal.

The mechanisms by which pitting and other valve damage occurs have been addressed in various patents and publications. For example, U.S. Pat. No. ("USP") 6,701,955 B2, "Valve Apparatus" by McIntire et al., describes how solid particles in a pumped slurry can become trapped between the two metal contact surfaces in the strike face area. The particles tend to be concentrated in specific locations rather than randomly distributed across those surfaces when concentrated slurries of particles are pumped. This creates concentrated stress forces at these locations and leads to localized pitting. The resulting pits or indentations in the metal surfaces are much wider than single particles. Once such pitting has occurred, the pits act as collection points and solid particles tend to concentrate at these locations on subsequent plunger strokes. This greatly accelerates the damage at these locations.

The above-mentioned technique involving resilient inserts has also been addressed by the present inventor. Valves used for slurry service typically have a resilient sealing insert around the outer perimeter of the valve closure member to provide effective valve sealing. Pressure applied to a closed valve forces the resilient sealing insert to become a hydraulic seal and a portion of the insert is extruded into the gap between the valve closure member and the valve seat member. For the insert to affect a hydraulic seal upon valve closure, the insert must protrude from the valve closure member toward the valve seat member when the valve is open. The amount of protrusion of the insert is called the insert offset. When the valve is nearly closed, the resilient sealing insert contacts the valve seat member before the contact surfaces of the valve closure member and the valve seat member make contact. When the valve is closed, the resilient sealing insert is deformed against the seat member to form the hydraulic seal, and metal-to-metal contact occurs between the valve closure member and the valve seat member in the strike face area. The resilient insert material does not compress but deforms. Repeated deformation of the insert material causes internal heat build-up and material stress within the insert material, and this can damage it. The insert material has low thermal conductivity, and even when bathed in flowing fluid the insert can overheat and be permanently deformed if exposed to large percentage deformations of the insert material.

Damage to the valve insert is also caused by large deformations of the insert material beyond its elastic limit. The elastic limit is an intrinsic property of the material, so the critical deformation is the percentage deformation defined as the deformation per volume unit of the material. If a large insert deformation occurs over a large volume of the insert material, then the percentage deformation can be low, causing minimal damage.

Proppant trapped under the resilient sealing insert can become temporarily or permanently embedded in the resilient insert material, so that the insert can contact the valve seat and affect a hydraulic seal in the presence of proppant. In the presence of proppant, the metal surfaces of the valve closure member and valve seat member do not form a good hydraulic seal. Under pressures typical of oilfield operations, the resilient insert deforms to press against the outer perimeter of the metal-to-metal contact area and makes the hydraulic seal there.

If proppant is trapped between the contact surfaces of the valve seat member and valve closure member, the metal-to-metal seal is not made. The resilient insert is extruded into the gap between the contact surfaces by the differential pressure across the valve. That differential pressure across the valve apparatus will build from zero, before the valve closes, to the full pump output pressure as the valve closes and the plunger actions continue. When the pressure forces on the valve closure member become high enough to crush proppant trapped between the metal contact surfaces, the gap between the contact surfaces decreases from the proppant diameter to the height of the crushed proppant particles. Just before the proppant is crushed, the insert is subjected to extrusion into a gap width defined by the proppant particles' diameter, with an extrusion pressure just less than the pressure required to crush the proppant. If proppant particles are piled up in the contact area, the extrusion gap can be larger than the diameter of individual particles. After the proppant is crushed, the gap between the two contact surfaces is reduced to the width of the crushed proppant debris. Then the insert is subjected to extrusion into that smaller gap, with an extrusion pressure equal to the maximum differential pressure across the pump.

The resilient sealing insert contacts the valve seat member before the valve closure member contacts the valve seat member. The gap between the sealing insert and the seat of an open valve is smaller than the gap between the valve closure member and the valve seat. This is required in order to have the resilient sealing insert contact the valve seat before the valve closure member and make a hydraulic seal. As the valve closes, the gap between the sealing insert and the valve seat member becomes too small to pass particles in the fluid, while the gap between the valve closure member and the valve seat member is still large enough to pass particles into the region between them. Thus, a standard valve-sealing insert can act as a forward-screening element that concentrates proppant particles in the strike face area, particularly in the critical area near the outer perimeter of the strike face. Such concentrations of proppant particles enhance damage to the contacting surfaces of the valve closure member and the valve seat member.

If the pump is operated in such a way as to have valve lag, i.e. the discharge valve does not close until after the plunger starts its suction stroke, there will be reverse flow through the valve before it closes. Before the valve closes, the insert will approach the valve seat so that the gap between them is less than the proppant diameter. The sealing insert will screen out proppant particles from the reverse fluid flow, preventing the particles from entering the region between the valve closure member and the valve seat member. However, the volume of fluid without proppant, which flows through current valves during the short time interval between the onset of such reverse particle screening and the closure of the valve, typically is insufficient to displace the proppant-laden fluid from the valve before closure. Particles are still trapped between the valve closure member and the valve seat member. Additional fluid without proppant would be required to flush the gap between the contact surfaces of the valve closure member and the valve seat member before the valve closes enough to trap proppant particles in that gap.

The resilient insert should extend down below the frustoconical contact surface of the valve closure member by a distance greater than the diameter of the solid particles in the slurry being pumped. Otherwise, the valve can be held open by solid particles caught between the metal contact surfaces of the valve seat member and valve closure member, without the resilient insert member reaching the valve seat member to affect a hydraulic seal. The extension of the insert member below a parallel extension of the frustoconical contact surface of the valve closure member is referred to as the valve insert member's offset. Current valve assemblies have insert member offsets typically of 0.06 to 0.08 inches. Larger offsets would result in larger insert material deformations leading to heating and material failure. Current valve assemblies were developed for pumping slurries with proppant particles that typically would pass through a U.S. Standard Sieve of 20 mesh. The maximum proppant particle diameter to pass through that mesh is 0.032 inches, so an insert offset of 0.06 inches will allow the valve insert to contact the valve seat while there is proppant between the contact surfaces of the valve body and the valve seat. The insert will be deformed over particles trapped under the insert. However, larger proppant particles are being used today to increase the efficiency of oil and gas withdrawal following fracturing operations. Proppants pumped today can include some particles with diameters larger than the typical insert offsets of current valve assemblies.

Increasing the offset of the resilient insert member to accommodate larger diameter proppant particles, by allowing the insert member to contact the valve seat member while there are proppant particles between the contact surfaces of the valve closure and valve seat members, increases the deformation of the insert member when the valve is closed. That increases heating and deformation damage to the insert member. Additional deformation damage to the resilient insert member is caused by trapping proppant particles between the resilient insert member and the valve seat member when the valve is closed. Proppant particles trapped between the resilient insert member and the valve seat member deform the resilient insert member and may be embedded in the insert. Larger proppant particles will cause significantly increased deformation damage and embedment damage when trapped between the resilient insert member and the valve seat member when the valve closes.

U.S. Pat. No. 6,701,955 B2, "Valve Apparatus" by McIntire et al., describes the problems of packing proppant particles between the frustoconical contact surfaces of the valve closure member and the valve seat member, particularly near the outer perimeter of the strike face area, and teaches some ways to flush the proppant out of that space, mainly by trapping proppant particles between the resilient insert and the valve seat. The present invention has advantages over the apparatus described in U.S. Pat. No. 6,701,955 in that: a) it provides a volume of trapped slurry from which proppant is screened as that slurry is pumped through the area between the contact surfaces, b) it provides a cavity to accommodate proppant particles trapped under the insert without deforming and damaging the insert, and c) it provides an insert that will seal in the presence of large proppant particles without requiring large percentage deformation of the insert material.

U.S. Pat. No. 2,495,880 by Volpin shows a cylindrical plug, as part of the valve closure member, that protrudes down into the throat of the valve seat member when the valve is closed. U.S. Pat. No. 6,701,955 B2, "Valve Apparatus" by McIntire et al., teaches the use of such cylindrical plugs to increase the speed at which the valve closure member rises when the plunger starts to move forward and pump fluid through the valve apparatus, and to retard the descent of the valve closure member at the end of the plunger forward stroke. Retarding the descent of the valve closure member promotes valve lag that reduces the amount of proppant particles trapped under the valve and makes the reverse pumping aspect of the current invention more effective.

U.S. Pat. No. 7,000,632 B2, "Valve Apparatus" by McIntire et al., teaches the use of protrusions around the outer perimeter of the contacting surface of the resilient insert to provide a screening gap between that surface and the valve seat. This allows clear fluid (i.e., fluid without proppant particles) to flow in a reverse direction, from downstream of the valve, through the valve and to flush proppant particles from the gap between contact surfaces of the valve closure member and the valve seat member before the valve closes.

Another problem with conventional valves for high-pressure slurry pumps, such as the reciprocating plunger pumps mentioned above, is the impact of the valve closure member on the valve seat member when the valve exhibits valve lag, closing after the pump plunger has reversed direction. Valve lag can be useful for slurry pumps, because it can reduce the number of particles concentrated in the valve before closure. However, large amounts of valve lag lead to damage of conventional valves, as the valve closure member slams into the valve seat member with high velocity and considerable force in closing.

There is a need for improved valve assemblies that reduce the incidence of damage to the valve closure member and valve seat member caused by particulates in slurries. There is also a need to reduce valve insert damage due to compressive deformation, particularly for inserts with offsets large enough to accommodate large particles. There is also a need for valve assemblies that can operate efficiently while pumping slurries with large proppant particles. These needs are addressed by the present invention.

A valve apparatus that closes without particles trapped between the two metal contact surfaces in the strike face area would permit one to pump slurries without valve damage. Valve damage could also be significantly diminished by reducing or eliminating particles trapped near the outer perimeter of the metal contact surfaces. These are some of the objects of the present invention.

SUMMARY OF THE INVENTION

A novel valve apparatus has now been discovered having a longitudinal axis therethrough, comprising:

- a valve seat member that comprises a hollow bore and a first frustoconical contact surface that has an inner perimeter and an outer perimeter;
- a valve closure member that comprises a valve body and a second frustoconical contact surface that is adapted to seal against the first frustoconical contact surface in a strike face area, the valve closure member being movable along the longitudinal axis of the valve apparatus;
- a fluid flow path through the bore of the valve seat member and between the valve seat member and the valve closure member, the fluid flow path being closed when the second frustoconical contact surface is in contact with the first frustoconical contact surface;
- an elastomeric resilient valve insert member attached to the valve body member of the valve closure member, wherein said insert member:
  - (a) has an inner perimeter and an outer perimeter, the inner perimeter being adjacent the strike face area on the second frustoconical contact surface,
  - (b) is offset and adapted to contact the first frustoconical contact surface and form a seal therewith at the outer perimeter of the insert member before the first frustoconical contact surface comes in contact with the second frustoconical surface as the valve closes, and wherein
    - (i) the insert offset of the insert member is greater at its outer perimeter than at its inner perimeter, and
    - (ii) the insert offset of the insert member is greater at its outer perimeter than the diameter of the largest particle in any fluid to be pumped though the bore of the valve seat member,
  - (c) is deformable, but substantially non-compressible, and
  - (d) comprises a particle retaining means to accommodate solid particles that are trapped between the insert member and the valve seat member when the valve closes, said particle retaining means having at least one cavity (void space) that is in fluid contact with the flow path for fluids between the valve seat member and the valve closure member when the valve is open, and wherein said cavity
    - (i) has an opening in fluid contact with the flow path for fluids that is large enough for particles to pass through the opening and into the cavity,
    - (ii) is large enough to accommodate one or more solid particles within the interior of the cavity, and wherein
    - (iii) the volume of the cavity contracts as the valve closes, whereby slurry is forced out of the cavity into the flow path and whereby solid particles are screened from the fluid and retained within the cavity, and clear fluid is directed inwardly toward the hollow bore of the valve seat member over the surfaces of the first and second frustoconical contact surfaces.

The present invention relates to valve assemblies that can reduce the problem of solid particle damage within the valve thereby increasing valve life, can help reduce or avoid the insert deformation problems associated with pumping proppant particles and can increase pump efficiencies when pumping slurries containing particles. The present invention is well suited for use with pumps that inject particle-laden fluid during the treatment of oil and gas wells, but can be used for other purposes as well. Although reciprocating plunger pumps are specifically mentioned, the valves of the present invention can be used with piston pumps and other pumps.

The present invention addresses the need for reducing particulate damage to valve closure members and valve seat members, the need for accommodating large proppant particles without damage to valve insert members and the need for improving pump efficiencies when pumping slurries of solid particles. It does this by providing a cavity between the valve insert member and valve seat member. The cavity traps a volume of the pumped slurry as the valve closes. The cavity separates an inner insert sealing surface near the inner diameter of the insert from an outer insert sealing surface near the outer diameter of the insert. The outer sealing surface has a greater offset than the inner sealing surface. When the valve is closing, the outer sealing surface contacts the valve seat before the inner sealing surface does. Further closure of the valve deforms the insert and decreases both the volume of slurry between the insert and the valve seat and the volume of slurry in the cavity. The insert deformation and resulting decrease in those two volumes pump slurry in reverse flow from under the valve closure member toward the hollow bore (throat) of the valve seat. As the valve closes further, the gap between the inner sealing surface and the valve seat gets smaller. As the valve continues to close, that gap becomes too small for the particles in the slurry to pass through the gap. Then further valve closure and deformation of the insert pump particle-free fluid through the gap to flush particles from the space between the metal-to-metal contact areas of the valve closure member and valve seat member. The solid particles screened from the slurry by the gap are concentrated in a volume of slurry that remains in the cavity when the valve is completely closed. During the next plunger stroke, the valve opens and the concentrated slurry is displaced from the cavity and replaced by unconcentrated slurry, and the insert cavity returns to approximately it's original dimensions and volume.

The description above is for the common practice of the valve insert member attached to the valve closure member. If the valve insert member is attached to the valve seat member, then the cavity will be between the valve insert member and the valve closure member, and the cavity could be manufactured into the insert alone, into the valve closure member alone or as two cavity portions, one in the insert and the other in the valve closure member. In another embodiment, two inserts can be used, one attached to the valve closure member and the other attached to the valve seat member. In that case, the cavity would be formed between the two inserts.

One aspect of the invention is a valve apparatus that provides a large valve insert member offset without incurring a large percentage deformation of the insert material when the valve is closed. This valve apparatus has a longitudinal axis therethrough and comprises a valve seat member, a valve closure member, a fluid flow path, and a resilient valve insert member. The valve seat member is usually stationary, and comprises a hollow bore and a first frustoconical contact surface. The valve closure member comprises a body and a second frustoconical contact surface that is adapted to contact against the first frustoconical contact surface. The valve closure member is movable along the longitudinal axis of the valve apparatus (i.e., toward and away from the valve seat member). The fluid flow path extends through the bore of the valve seat member and between the valve seat member and the valve closure member. This fluid flow path is closed when the second frustoconical contact surface contacts the first frustoconical contact surface. The resilient valve insert member is usually attached to the valve closure member, but could be attached to the valve seat member. The resilient valve insert member extends downward from the valve closure member (or upwards from the valve seat member) when the valve is open. The valve insert member contacts the valve seat member, or valve closure member, before the frustoconical contact surfaces of the valve seat member and the valve closure member make contact as the valve closes.

The discussions below describe a valve assembly in which the valve insert member is attached to the valve closure member.

In the present invention, when the valve closes, the resilient valve insert member contacts the valve seat member and pressure forces on the valve deform the resilient valve insert member. Deformation of the valve insert member increases until the frustoconical contact surfaces of the valve closure member and the valve seat member make contact. After the frustoconical contact surfaces make contact, the metal-to-metal contact area between the valve seat member and the valve closure member absorbs the pressure forces closing the valve. The current invention provides for the deformation of the valve insert member to be spread over a larger volume of material than in current valve apparatus designs and thereby reduces the percentage deformation of the resilient valve insert member material. This is accomplished by allowing the outer portion of the insert to deform upwards rather than being confined by the top of the valve closure member. The deformation can also be spread over a larger portion of the insert material by removing some of the insert material to allow deformation within the volume formerly occupied by the insert material.

In current valve apparatus designs, the top of the valve closure member extends outward to the outer diameter of the valve insert member. In one embodiment of the present invention, the diameter of the top of the valve closure member is reduced to allow the valve insert to deform upwards rather than being constrained by the top of the valve closure member. In this embodiment, the top of the valve closure member is terminated at a diameter less than the outer diameter of the valve insert member. This allows the outer portion of the resilient insert member to deform upwards, and spreads the total deformation of the resilient valve insert member over a larger volume of the insert material, thereby decreasing the percentage deformation of the insert material. When the valve closes, the insert material is not forced to bulge out between the valve closure member and the valve seat, but the outer portion of the insert can flex upward in response to its contact with the valve seat member. This modification of the valve closure member does not decrease the effectiveness of the valve closure member to withstand the pressure applied to the closed valve. The reduction of the valve closure member diameter is not new; similar principles are seen in U.S. Pat. No. 2,495,880 by Volpin. However, in the present invention, the diameter reduction provides insert flexibility used in conjunction with an insert cavity described below to accommodate solid particles trapped under the insert and to provide a flow of particle-free fluid to clean the valve strike face prior to closure. Upward movement of the outer portion of the insert is not restricted by the valve closure member. This is beneficial.

Another aspect of this invention is modification of the resilient insert member to accommodate proppant particles trapped under the insert member when the valve closes. A portion of the usual insert material is removed to create a cavity in the insert with cylindrical symmetry about the central axis of the valve assembly. The opening of this cavity is at the bottom of the insert member. The cavity may extend above a geometric extension of the valve closure member's frustoconical contact surface, so that the central portion of the cavity has a negative insert offset. The cavity is bordered by an inner sealing surface and an outer sealing surface of the valve insert member. These sealing surfaces have different amounts of offset from the extension of the valve closure member's frustoconical surface. The resilient insert member in this embodiment has two concentric sealing rings, the sealing surfaces described above. Between the two sealing surfaces is a cavity with cylindrical symmetry in the insert that may extend above the extension of the strike face. There are particular advantages for the outer sealing surface having a larger offset than the inner sealing surface. After the valve has closed enough for the outer sealing surface of the insert to contact the valve seat member, further closure of the valve will force slurry below the insert to flow in reverse direction through the gap between the contact surfaces of the valve seat member and the valve closure member, through the strike face area gap between the valve closure member and the valve seat member. The closing gap between the inner sealing surface of the insert and the valve seat member will screen proppant particles from that slurry before the valve is completely closed, providing a flow of particle-free fluid to flush the gap between the contact surfaces of the valve seat member and the valve closure member. A reduction in the number of particles trapped and crushed between the valve's frustoconical contact surfaces will increase the life of the valve.

It is particularly advantageous to have the bottom of the outer sealing surface narrow enough to move through flowing slurry without trapping proppant particles between the outer sealing surface and the valve seat member. The outer sealing surface does not provide the hydraulic seal at the outer perimeter of the metal-to-metal contact area of the valve closure member and valve seat member. That hydraulic seal is provided by the inner sealing surface. Therefore, the outer sealing surface can be narrow without compromising the effectiveness and durability of the final hydraulic seal. Another advantage to this embodiment is hydraulic cushioning of the impact of the valve closure member on the valve seat member when the valve is operated under conditions with valve lag. The present invention converts at least some of the kinetic energy of the closing valve into kinetic energy for fluid forced out of the cavity and into the fluid flow path between the valve seat member and the valve closure member; this high velocity clear fluid flushes proppant particles from the valve before closure. In addition, the valve closure member is slowed down as the process of pumping fluid from the cavity provides a hydraulic cushioning of the valve closure. This is beneficial.

The inner and outer sealing surfaces of the insert member have different materials requirements. The outer seal can be made from material that is more flexible and less resistant to extrusion, while the inner seal material primarily needs extrusion resistance. Separating these two functions in separate regions of the insert means that two or more different resilient materials can be used to provide a more effective insert design.

In another embodiment, the resilient insert member has a plurality of concentric sealing surfaces separated by cavities with cylindrical symmetry in the insert. The cavities may extend above the extension of the strike face of the valve closure member.

In another embodiment, the resilient insert member has a plurality of individual cavities which are not connected and which can accommodate proppant particles trapped under the resilient insert when the valve closes.

In another embodiment, the cavity between the valve insert member and the valve seat member is comprised of two cavity portions, one in the valve insert member and one in the valve seat member. Building the cavity as two portions reduces effects of the cavity shape upon slurry flow through the open valve. It also provides advantages in screening out particles from the slurry to provide particle-free fluid to clean the strike face area gap before the valve closes. It also enhances flushing of concentrated slurry from the cavity when the valve opens and slurry is pumped through the space between the cavity portions.

The present invention can be practiced with various manufacturing techniques for the resilient insert member. The resilient insert member can be manufactured in place on the valve closure member, or can be manufactured independently and installed on the valve seat member by known procedures.

BRIEF DESCRIPTION OF THE FIGURES

FIG. 1 is a simplified cross sectional view of a typical plunger type pump having a cylindrical valve apparatus in place.

FIG. 2 is a simplified cross sectional view of a valve assembly portion of a plunger type pump. This figure shows the typical location of a resilient sealing insert attached to the valve closure member.

FIG. 3 illustrates a valve insert with a constant offset.

FIG. 4 illustrates a valve insert with a tapered offset.

FIG. 5 illustrates the deformation of the valve insert of FIG. 3 or 4 when the valve is closed.

FIG. 6 illustrates solid particles (e.g., proppant) trapped between the valve seat and the valve closure member and/or the insert members. This Figure also illustrates the problem (s) caused by the trapped particles. Trapped particles larger than the insert offset prevent the valve from closing fully and forming a hydraulic seal between the insert and the valve seat. Smaller particles trapped between the metal contact surfaces create points of high contact stress in the strike face area and cause pitting.

FIG. 7 illustrates deformation of the insert due to proppant particles trapped between the insert and the valve seat when the valve is closed.

FIG. 8 illustrates a modification of the top of the valve closure member to allow an outer portion of the valve insert to deform upwards.

FIG. 9 illustrates the upward deformation of the insert when the valve closure member is modified as shown in FIG. 8.

FIG. 10 illustrates an embodiment of the present invention in an open position. The cavities in the insert member provide a means to accommodate solid particles (e.g., proppant) that are trapped as the valve closes. The cavities also provide clear (i.e., particle-free) fluid that flushes the strike face area as the valve closes.

FIG. 11 illustrates the outer sealing portion of the insert member contacting the valve seat member as the valve apparatus in FIG. 10 begins to close.

FIG. 12 illustrates the valve apparatus of FIG. 10 in the closed position.

FIG. 13 illustrates an embodiment of the present invention in which the valve insert has a plurality of cavities to accommodate proppant particles and provide clear fluid to flush the strike face area as the valve closes.

FIG. 14 illustrates a slurry of proppant particles within the valve apparatus of FIG. 13, when the valve is open.

FIG. 15 illustrates the slurry of proppant particles within the valve apparatus of FIG. 13, at the moment of initial valve closure when the outer perimeter sealing surface of the valve insert contacts the valve seat.

FIG. 16 illustrates the valve apparatus of FIG. 13, closed with proppant particles trapped under the insert and other proppant particles flushed from the gap between the valve closure member and the valve seat.

FIG. 17 illustrates a projected view of the areas of the prior art insert and valve closure members that are in contact with the valve seat in FIG. 5.

FIG. 18 illustrates a projected view of the areas of the valve insert member and valve closure member that are in contact with the valve seat in the embodiment of the invention illustrated in FIG. 12.

FIG. 19 illustrates a projected view of the areas of contact of the valve insert member and valve closure member that are in contact with the valve seat member when webbing sections (88) are added to the valve insert member of FIG. 12 to divide the cavity into multiple zones (86).

FIG. 20 illustrates the areas of the valve seat insert and valve seat member that are in contact with the valve seat member when the valve insert contains a plurality of unconnected cavities to provide space for proppant trapped beneath the insert upon valve closure.

FIG. 21 illustrates a cross-sectional view of an embodiment of the invention in which the insert cavity extends above the outer perimeter of the inner sealing surface FIG. 22 illustrates a cross-sectional view of an embodiment of the invention in which the insert member comprises two resilient elastomeric materials bonded together.

FIG. 23 illustrates a cross-sectional view of an embodiment of the invention in which the top of the valve closure member is the same or substantially the same as the outer diameter of the valve seat and the outer diameter of the valve insert.

FIG. 24 illustrates cross-sectional views of four embodiments of the invention in which the cavity (52) has different cavity shapes.

FIG. 25 illustrates a cross-sectional view of the embodiment of the invention from FIG. 21 with the addition of protrusions (70) near the outer perimeter of the inner sealing surface.

FIG. 26 illustrates the insert from FIG. 25 with the addition of protrusions (70) near the outer perimeter of the outer sealing surface of the insert. FIG. 26 also illustrates an embodiment of the invention in which the top of the insert (61) has been carved away to reduce the force required to upwardly deform the insert and seal the valve.

FIG. 27 illustrates the embodiment of the invention from FIG. 26 with two additional features. The outer cavity wall (57) is slanted inwardly so that the insert deforms into the cavity, thereby decreasing the cavity volume when the valve closes. This increases the volume of particle-free fluid pumped from the cavity to flush the strike face area. FIG. 27 also illustrates an embodiment of the invention in which the top of the valve closure member (35) curves over the insert.

FIG. 28 illustrates an embodiment of the invention in which the cavity to accommodate trapped particles and clear fluid to flush the strike face area is comprised of a cavity portion in the valve insert and a matching cavity portion in the valve seat.

FIG. 29 illustrates an embodiment of the invention in which the bottom of the valve closure member is modified to include a lifting plug (90).

DESCRIPTION OF ILLUSTRATIVE EMBODIMENTS

Figure 1:
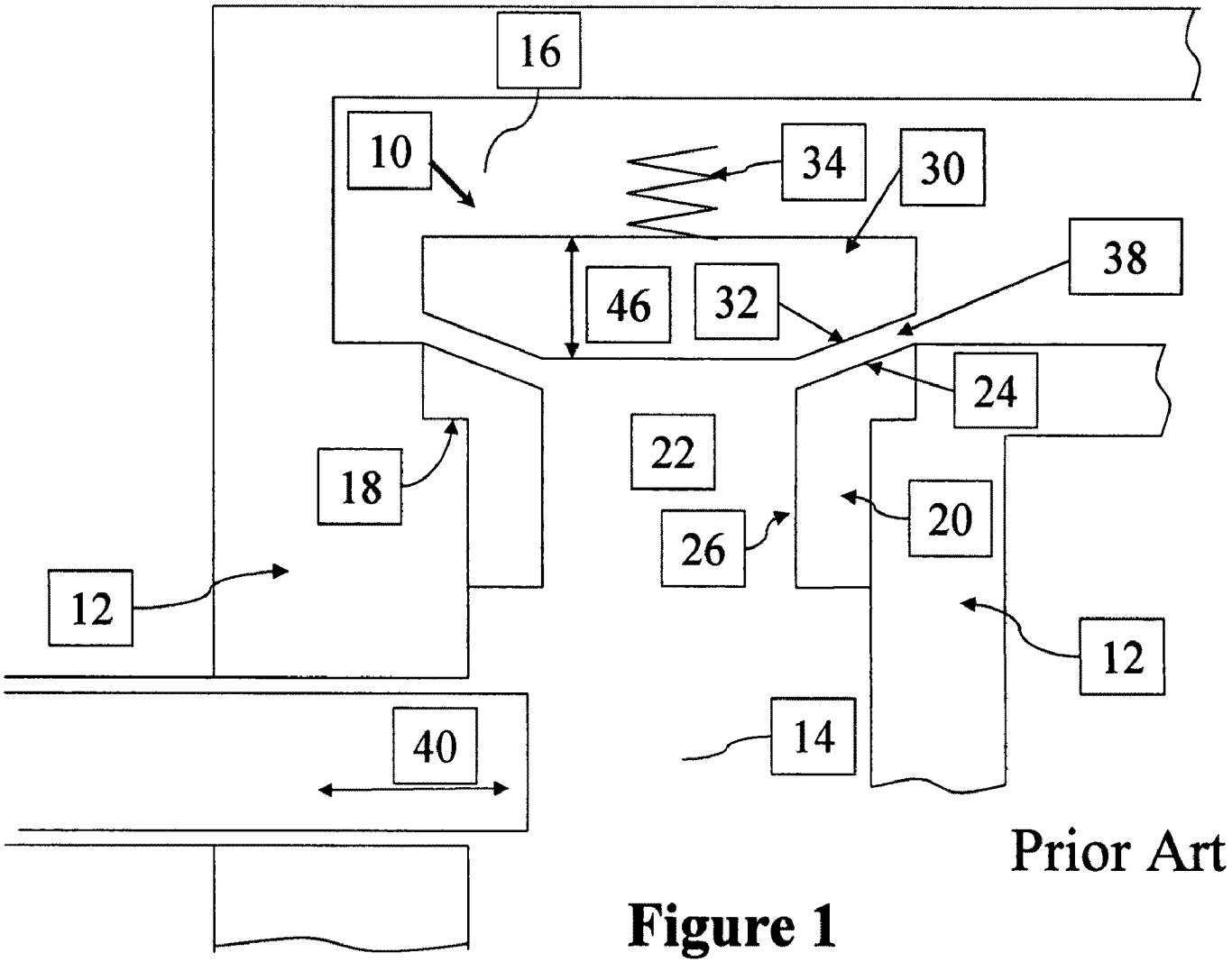
Prior Art Figure 1
FIGS. 1-16 are cross sectional views of various valve apparatus, all of which have cylindrical symmetry. With cylindrical symmetry, labels shown on one side of these Figures apply as well to the corresponding features on the other side.

The present invention is illustrated by reference to certain valve assemblies used as discharge valve assemblies in a plunger-type pump. However, the valve assembly of the present invention can also be used in other applications. It will be understood that the valve assemblies of the present invention can be used as a discharge valve or as a suction valve in such reciprocating plunger pumps and other high pressure pumps. In this patent application, terms such as "above", "below", "upward" and "downward" will be used relative to the frame of reference shown in the drawings, and the terms "valve assembly" and "valve assemblies" may be used interchangeably with "valve apparatus."

Referring to FIG. 1, a simplified cross sectional view of a typical high-pressure pump (such as a plunger pump) having a cylindrical valve apparatus in place, shown generally as 10. The valve apparatus 10 fits in the pump body 12, which forms an intake or pressure chamber 14 and a discharge chamber 16. An annular wall 18 in the pump body 12 provides a means for receiving a valve seat member 20. The valve seat member 20 comprises a hollow bore 22 that provides a fluid flow path between the intake chamber 14 and the discharge chamber 16. The valve seat member 20 has a frustoconical contact surface 24 and a generally cylindrical inner wall 26 that defines the valve seat member bore 22, and which can act as a guide surface. A valve closure member 30 has a frustoconical contact surface 32 that is complimentary to the frustoconical contact surface 24 of the valve seat member 20. A compression spring 34 urges the valve closure member 30 downward toward the valve seat member 20 to create a contacting relationship between the frustoconical contact surface 24 and the frustoconical contact surface 32. The valve apparatus 10 shown in FIG. 1 is a discharge valve assembly. A similar suction valve assembly (not shown) would also be attached to the pump body 12, below the intake chamber 14. In operation and as known in the art, the discharge stroke of the plunger 40 results in an elevated pressure within the intake chamber 14. The elevated pressure within the intake chamber 14 causes the valve closure member 30 to move away from the valve seat member 20 as shown by the arrow 46. This allows fluid to be displaced from the intake chamber 14, through the valve seat member bore 22, and into the discharge chamber 16. Fluid flow from the intake chamber 14 into the discharge chamber 16 is referred to as forward flow through the valve apparatus 10. When the valve closure member 30 is raised by fluid forces arising from the forward motion of the plunger 40, the compression spring 34 is compressed and exerts a force downward on the valve closure member 30. When the plunger 40 slows towards the end of its discharge stroke, the fluid forces upward on the valve closure member 30 decrease and become less than the spring force downward on the valve closure member 30. The valve closure member 30 is pushed downward towards its closed position against the valve seat member 20. The compression spring 34 moves the valve closure member 30 towards the valve seat member 20 to reestablish the contacting relationship between frustoconical contact surface 24 and frustoconical contact surface 32. Further movement of the plunger 40 in a suction stroke will create suction within the intake chamber 14 and the aforementioned suction valve assembly (not shown) will work in a similar manner, allowing fluid to be drawn into the intake chamber 14. At the start of the plunger 40 suction stroke, a small amount of fluid flows from the discharge chamber 16 back into the suction chamber 14. This is referred to as reverse flow through the valve apparatus 10. This reverse flow will continue until the combined forces of the suction pressure within the intake chamber 14, the discharge pressure in chamber 16 and the compression spring 34 are sufficient to form a positive seal between the valve closure member 30 and the valve seat member 20. Inertia of the moving valve plays a role in its closing, but does not change the descriptions of the present invention.

Forward flow and reverse flow through the valve apparatus 10 have separate working mechanisms and are not equivalent. Forward flow results when the pressure in the intake chamber 14 is sufficiently greater than the pressure in the discharge chamber 16 that it overcomes the resistance force applied by the compression spring 34. Forward flow involves hydrostatic pressure and then flowing fluid forces overcoming a resisting force. Reverse flow also needs a pressure differential across the valve assembly 10. However, rather than the pressure differential overcoming an opposing force, reverse flow involves the time lag inherent in the valve closure member 30 closing. Once the pressure has equalized between the intake chamber 14 and the discharge chamber 16, the forward flow of fluid will stop. At that time, the valve closure member 30 will still be in the process of approaching the valve seat member 20, moving in response to the force from the compression spring 34. The time period between the cessation of the forward fluid flow and the closing of the valve closure member 30 upon the valve seat member 20 is commonly referred to (and is defined for use herein) as "valve lag." As the plunger begins its suction stroke, the pressure within the intake chamber 14 is reduced to less than the pressure within the discharge chamber 16. This results in a reverse fluid flow through the discharge vale until there is an adequate fluid seal between the valve closure member 30 and the valve seat member 20. If an adequate fluid seal (hydraulic seal) between the valve closure member 30 and the valve seat member 20 is not achieved, there will be reverse fluid flow throughout the entire suction stroke, and pump efficiency will be decreased.

Figure 2:
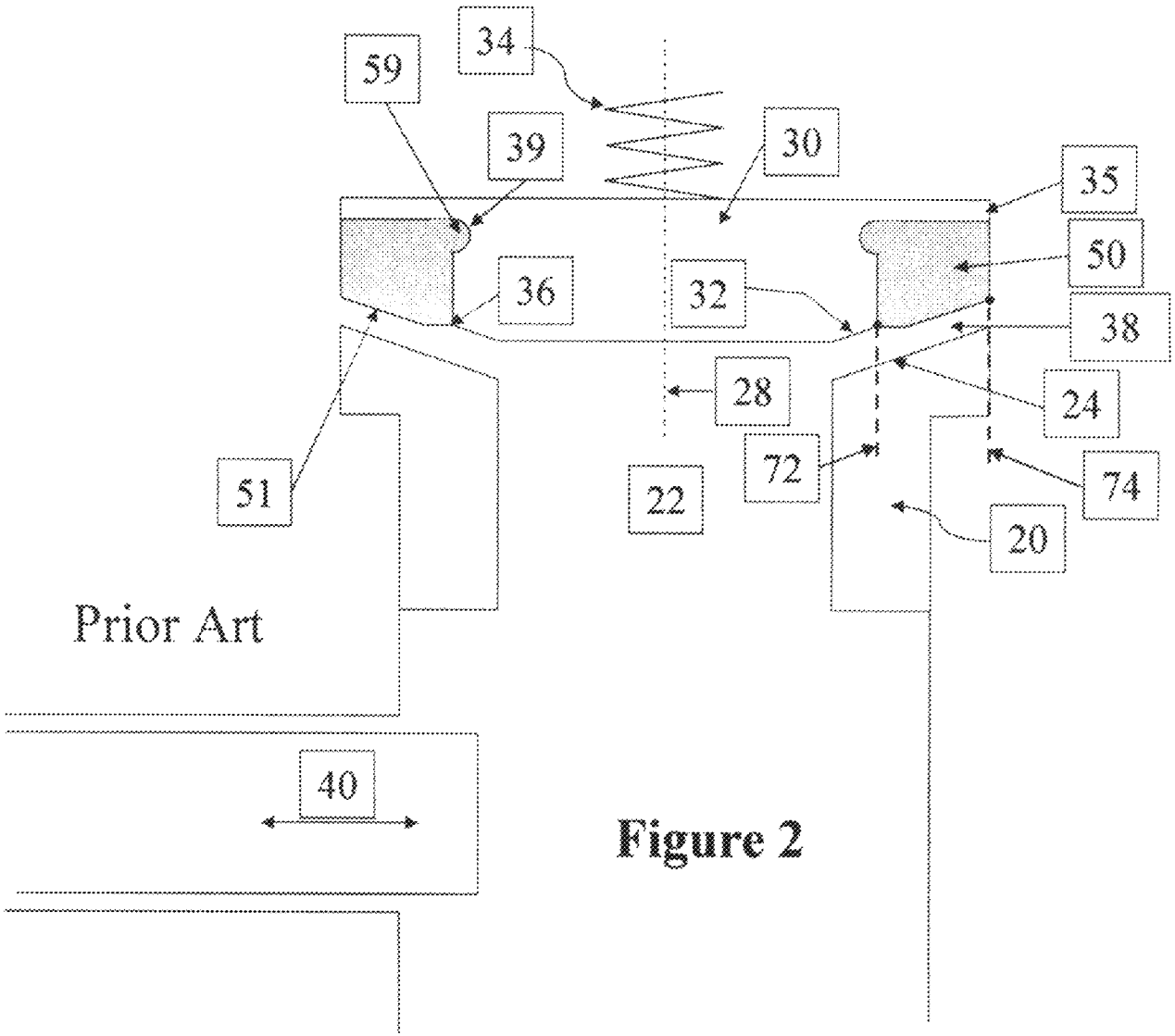

FIG. 2 is a simplified cross-sectional view of a valve assembly portion of a plunger type pump, and it shows the typical location of a resilient elastomeric sealing insert attached to the valve closure member. The valve assembly has cylindrical symmetry about its central axis 28. A resilient sealing insert 50 is attached to the valve closure member 30 at its outer perimeter. The distance between the frustoconical contact surface 51 of resilient insert 50 and the opposing frustoconical contact surface 24 creates a valve exit gap 38. The resilient insert 50 helps make a fluid seal between frustoconical contact surface 24 and frustoconical contact surface 32 when the valve closes. The resilient insert also acts to dampen the stress forces imposed as the valve closure member 30 impacts the valve seat member 20 upon valve closure. For the resilient elastomeric sealing insert 50 to be effective, the valve exit gap 38 between the contact surface 51 of resilient sealing insert 50 and the valve seat contact surface 24 must be smaller than the gap between the valve closure member contact surface 32 and the valve seat contact surface 24, when the valve is open. The resilient sealing insert 50 is constrained by the valve closure member 30, and not allowed to deform upwards due to the top portion 35 of the valve closure member 30.

Although the resilient insert is attached to a modified valve closure member 30 in FIG. 2, a similar, vertically mirrored could be attached to a valve seat member modified to hold the insert as the valve closure member in FIG. 2 does. There can also be a resilient insert on each of the valve closure member and valve seat member.

On many valves, the resilient insert 50 has a cylindrical inner bulge 59 that fits into a corresponding cylindrical cavity (groove) 39 in the valve closure member 30. This feature is used to help retain the insert on the valve closure member, particularly when the insert is manufactured separately from the valve closure member and not bonded to it. In such instances, the valve is typically assembled by sliding the circular insert over the cylindrical outer perimeter of the closure member until it snaps into place, much like placing a rubber "O-ring" onto a grooved piece of metal bar. Alternatively, the resilient insert member may be bonded to the valve closure member. In such instances, the resilient insert may be formed in situ by pouring a chemically reactive substance (e.g., a polyurethane reaction mixture) into an appropriate mold around the valve closure member. Either method may be used to prepare the valve apparatus illustrated by FIG. 2 and the other attached Figures.

Dashed lines 72 and 74 in FIG. 2 represent, respectively, the inner and outer radii of the bottom of the resilient insert member 50. The width of the insert is the difference of those two radii. Inner radius 72 corresponds to the outer perimeter 36 of the frustoconical surface 32 of the valve closure member. In FIG. 2, radius 74 happens to be equal to the outer radius of the valve closure member, but that is not necessary and radius 74 may be greater or lesser than the outer radius of the valve closure member.

The area where the frustoconical surfaces 32 and 24 meet is called the strike face area of the valve and valve seat. That is the area of metal-to-metal contact when the valve is closed.

Figure 3:
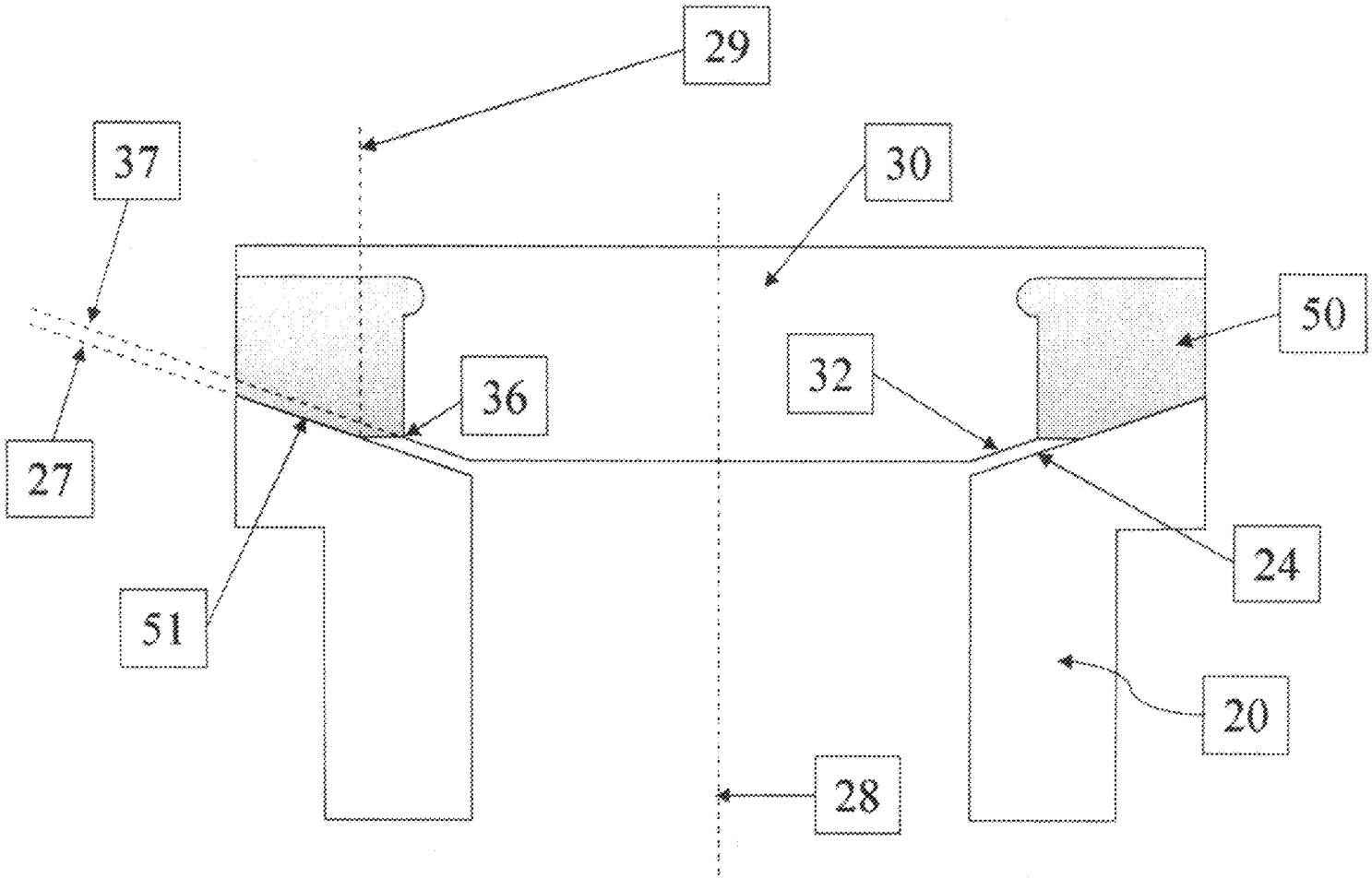
Prior Art Figure 3

FIG. 3 illustrates a valve insert with a "constant offset," the offset of the contact surface 51 perpendicularly from an extension 37 of the frustoconical surface 32 of the valve closure member 30. This is shown with the sealing insert 50 contacting the frustoconical surface 24 of valve seat member 20, and before any deformation of the insert. Line 37 shows the extension of the valve closure member frustoconical sealing surface 32. Line 27 represents the extension of the valve seat member frustoconical sealing surface 24. Lines 37 and 27 are provided to illustrate the perpendicular offset of contact surface 51 of the insert from the extension 37 of contact surface 32. That offset is usually referred to (and defined for use herein) as the "insert offset." The volume of insert material below the extension 37 of the surface 32 in FIG. 3 must be displaced for the valve to close completely and for the frustoconical sealing surfaces 32 and 24 to make contact.

The inserts illustrated in FIGS. 2 and 3 start with zero offset at their inner radii. Those radii match the outer perimeter 36 of the frustoconical surface 32 of the valve closure member. The insert offset increases uniformly with distance from the central axis 28 of the cylindrical valve apparatus, until it reaches the maximum insert offset at a radius 29. At radii greater than radius 29, the inserts have a uniform offset. In FIG. 3, this is evident, as the insert uniformly contacts the surface 24 of valve seat member 20 at any radius greater than 29. A uniform or constant offset insert as illustrated in FIG. 3 is used commonly in the industry today.

Figure 4:
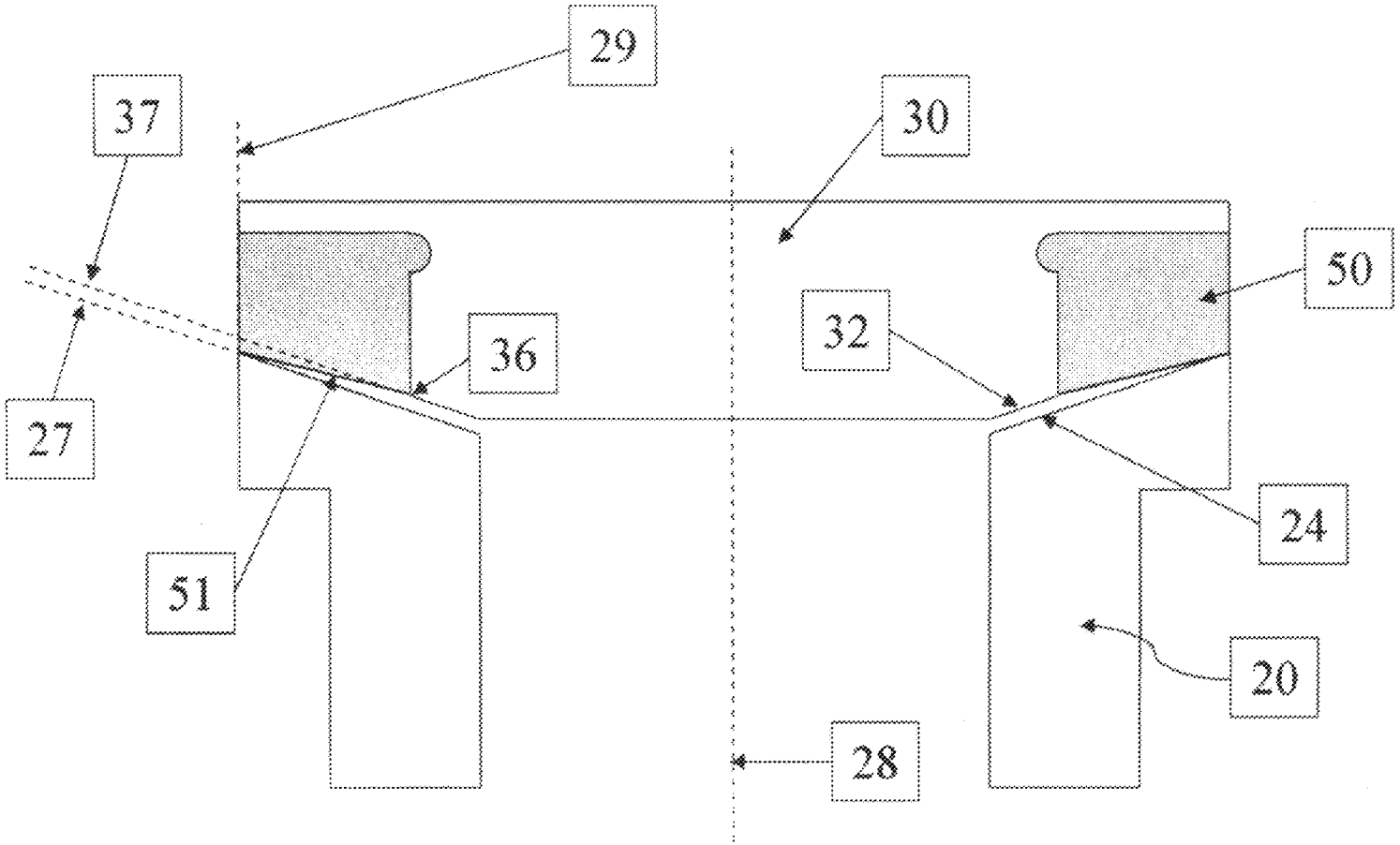
Prior Art Figure 4

FIG. 4 illustrates a valve insert with a tapered offset. In this Figure, the bottom of the insert has a tapered, uniformly increasing offset from the outer radius 36 of contact surface 32 and reaches a maximum offset at radius 29. A tapered insert as illustrated in FIG. 4 is also commonly used in the industry today. The problems normally associated with large proppant particles occur with either constant-offset or tapered-offset inserts.

Figure 5:
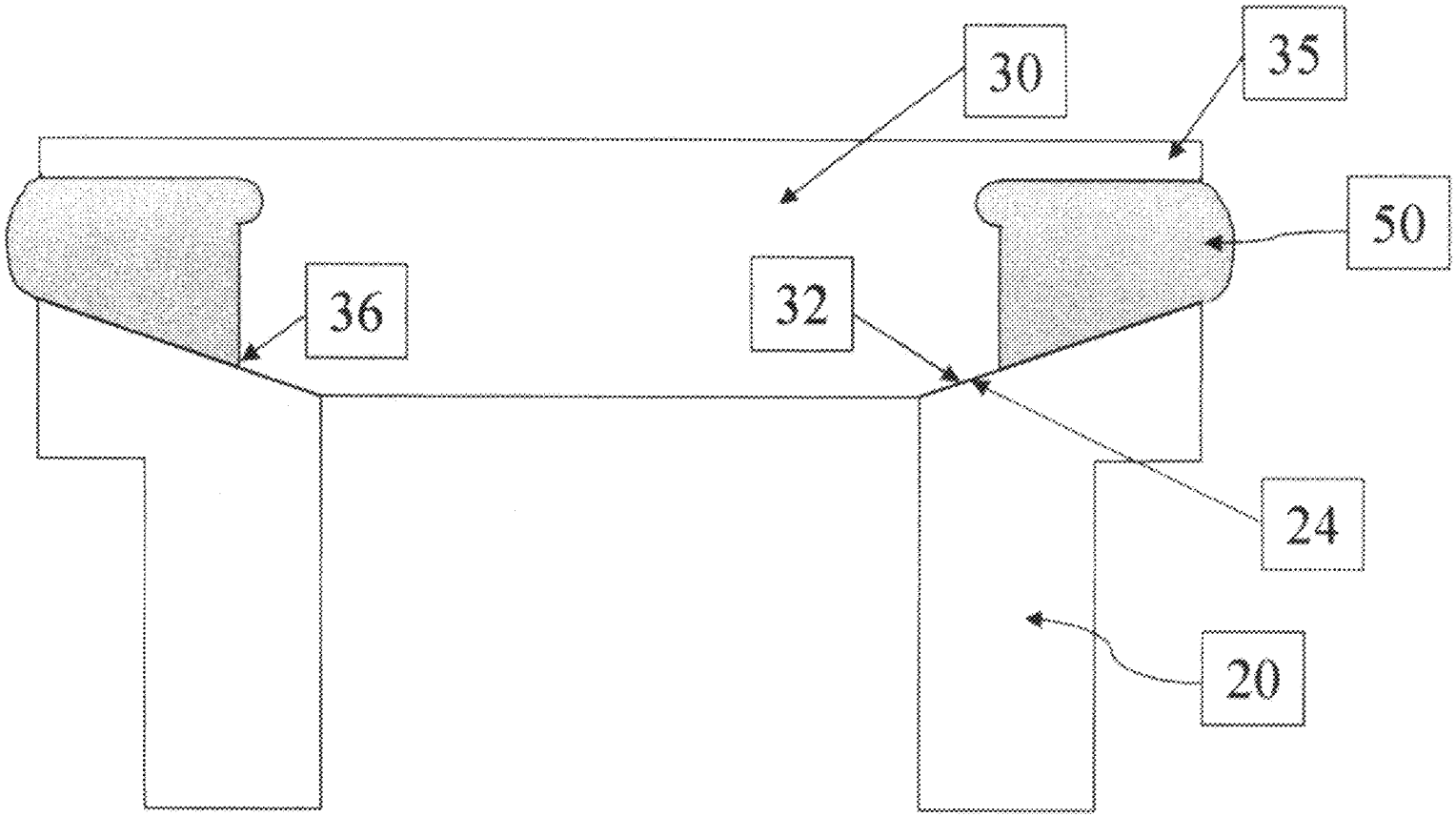
Prior Art Figure 5

FIG. 5 illustrates the deformation of the valve insert 50 of FIG. 3 or 4 when the valve is closed. The outer top portion 35 of the valve closure member 30 restrains the insert and does not allow it to deform upwards when the valve closes. The volume of insert material squeezed out beyond the outer perimeters of the valve closure member 30 and the valve seat member 20 nearly equals the volume of insert material below the extension 37 of surface 32 in FIG. 3 or in FIG. 4.

The resilient insert material is typically not very compressible. Under pressure, the insert deforms rather than compresses. Forces required to deform the insert material are small compared to the pressure forces exerted on the valve members during typical operations. When the valve is closed, the insert material transmits pressure and deforms to plug any irregularities or gaps between the frustoconical surfaces 32 and 24 of the valve closure member 30 and the valve seat member 20 at the perimeter 36. When the valve is closed, the insert helps create a hydraulic seal at the outer perimeter 36 of surface 32 of the valve closure member 30.

Figure 6:
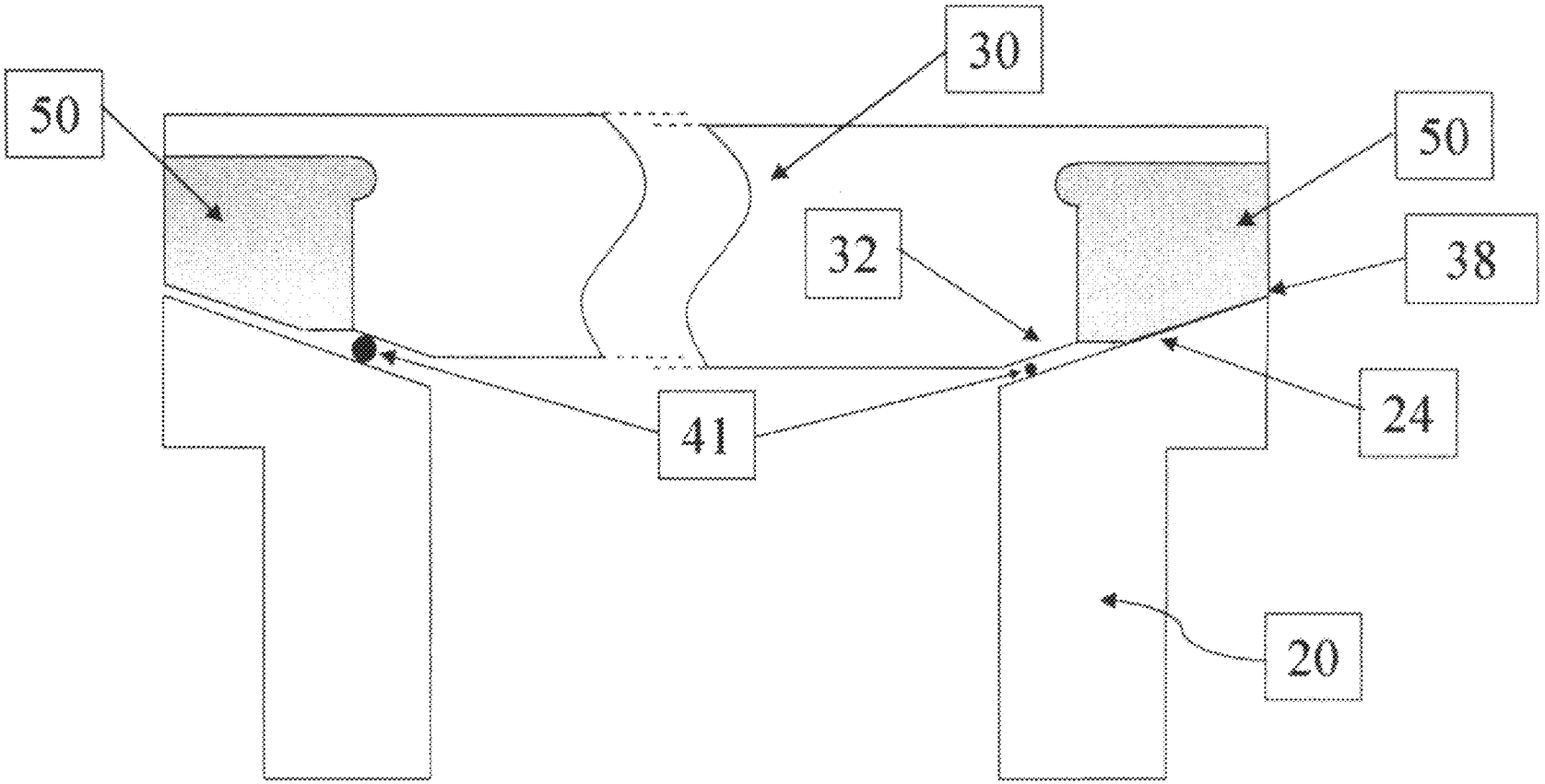
Figure 6 Prior Art

FIG. 6 illustrates solid particles (e.g., proppant) trapped between the valve seat and the valve closure member. This Figure also illustrates the problem(s) caused by the trapped particles. If the trapped particle is larger than the insert offset, it prevents the valve from fully closing and forming a hydraulic seal between the insert and the valve seat in the strike face area. If a particle is trapped between the metal contact surfaces in the strike face area, the particle(s) create points of high contact stress in the strike face area and can cause pitting. The left side of FIG. 6 illustrates a proppant particle 41 that is trapped between the frustoconical surfaces 32 and 24 of the valve closure member 30 and valve seat member 20. Particle 41 is larger than the insert offset, and it prevents the valve from closing and forming a hydraulic seal between the insert and the valve closure member. The right side of FIG. 6 illustrates another smaller particle 41 trapped between the metal surfaces in the strike face area. All particles trapped in the strike face area can cause pitting which, in turn, prevents the metal surfaces of the valve closure member and the valve seat member from forming a hydraulic seal when the valve is closed. Such conditions cause inefficient pump operation by allowing reverse flow through the discharge valve during the plunger suction stroke. In addition, particles in the high velocity fluids backflowing through the valve during the plunger suction stroke are abrasive and erode the valve components. For simplicity, proppant particles are described and illustrated herein as being spherical and having a diameter. In practice, proppant particles or other solid particles in slurries may have irregular non-spherical shapes and have a nonuniform size distribution.

If the offset of the insert 50 on the left side of FIG. 6 is increased enough for the insert to contact the valve seat surface 24 by making the insert offset larger than the largest proppant particle's diameter, insert damage from two sources would increase. First, in the absence of any proppant, the deformation of the insert illustrated in FIG. 5 would be increased. Second, extrusion damage to the insert material would increase, due to the large extrusion gap created by the proppant between the contact surfaces 32 and 24. The insert would be deformed by pressure above the valve and extruded into the large gap. The resulting percentage deformations of the insert material would be large enough to damage the insert.

The right side of FIG. 6 illustrates the valve closing onto a smaller proppant particle. The valve closure member 30 shown on the right hand side of FIG. 6 is lower than shown on the left hand side. The proppant particle on the right hand side is smaller than the insert offset, so the insert 50 can contact the valve seat member 24. Damage to the valve members in the strike face area is caused when the trapped proppant particles are crushed between the metal surfaces of the valve closure and valve seat members 30 and 20. Similarly, the insert member can be damaged by extrusion of the valve insert into the gap between the valve closure and valve seat members. In the absence of particles, that gap is small, and insert damage is minimal. With particles holding the metal surfaces apart, the extrusion gap is larger and more insert damage occurs.

Figure 7:
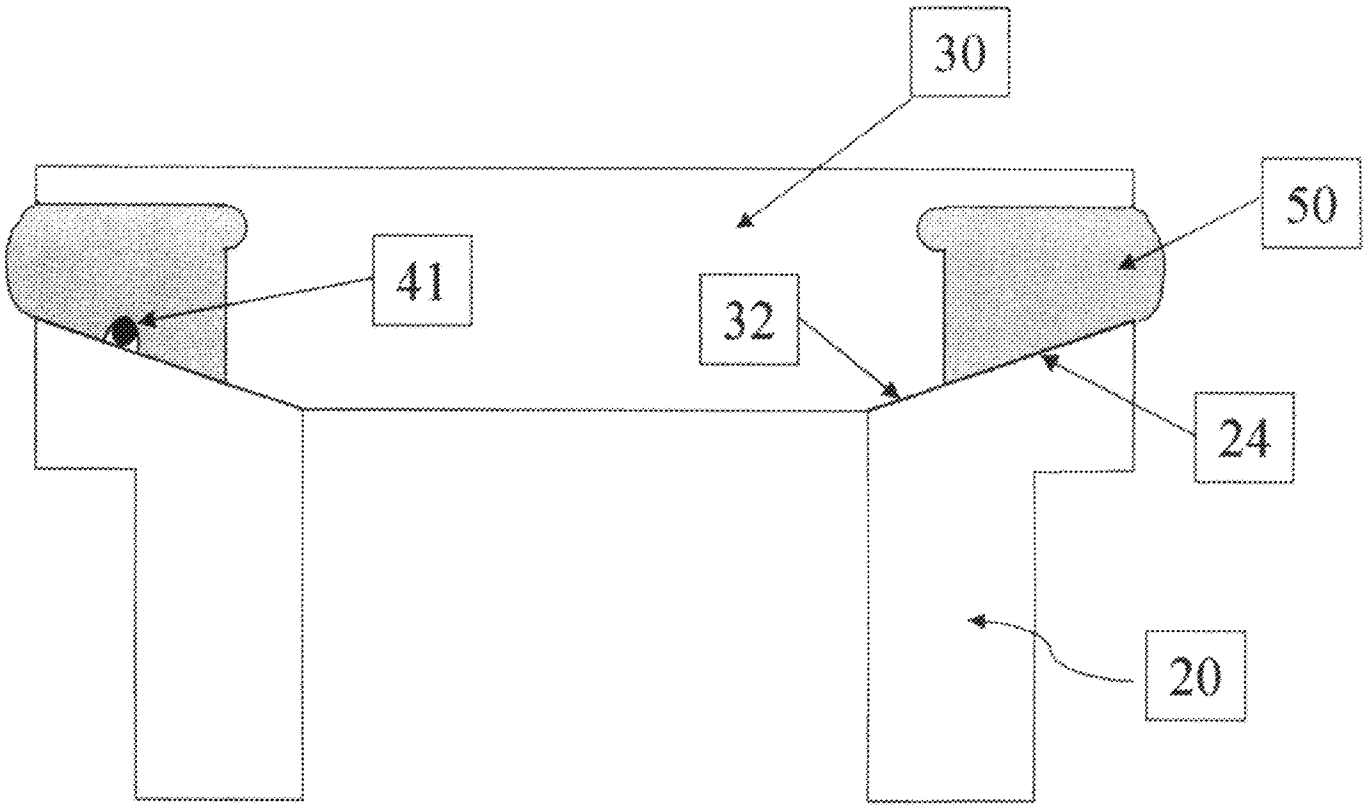
Prior Art Figure 7

FIG. 7 illustrates another problem with prior art valve designs used with large proppant particles. Proppant particle 41 is trapped between the resilient insert 50 and the surface 24 of the valve seat 20, and is embedded in the insert 50. This embedment can be temporary or can be permanent if the insert material is deformed enough to cause local damage. Larger proppant particles cause more deformation of the insert material and more deformation damage.

Before the proppant particle 41 is embedded in the resilient valve insert material, sufficient downward force must be exerted on the valve to deform the insert material. That force is created by differential pressure across the valve. Before the proppant particle is embedded in the insert, the insert does not affect a hydraulic seal, and an open flow path exists through the valve. Differential pressure across a valve with an open flow path 38 is caused by fluid flow through the flow path. Before sufficient force is generated to deform the insert to embed the proppant particle, fluid flows at high velocities through the gap between the valve insert and the valve seat. This reverse flow through a valve decreases the efficiency of the pump. Abrasive particles in the slurry smaller than the embedding proppant particle flow with the fluid through the gap and erode valve components.

Figure 8:
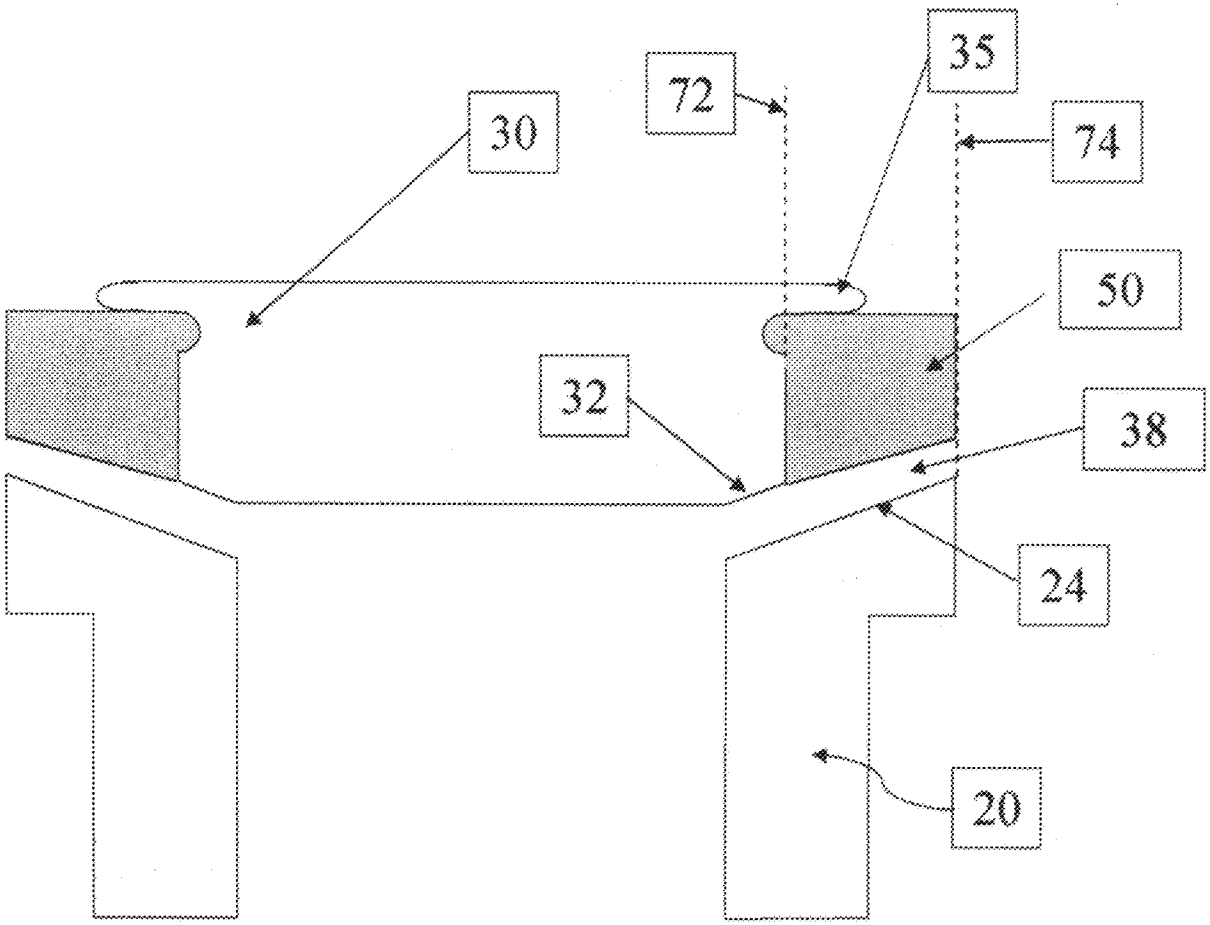
Figure 9:
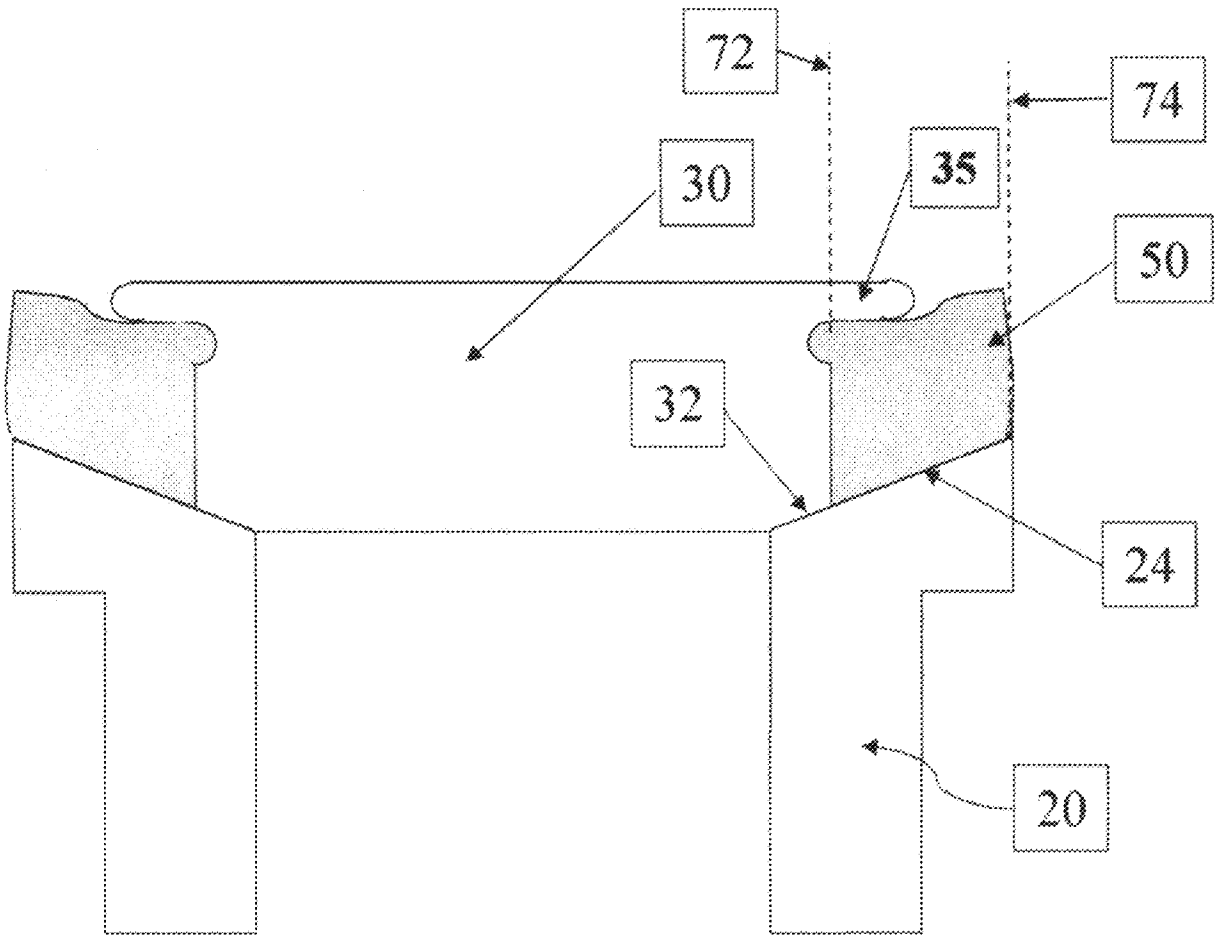

FIGS. 8 and 9 illustrate a feature that can be used in the present invention to reduce percentage deformation of the valve insert material. FIGS. 8 and 9 illustrate a means whereby the outer portion of the resilient insert can flex upwards and spread the deformation over a larger volume of the insert material. Upward movement of the outer portion of the insert is not restricted by the valve closure member. FIG. 8 shows the outer radius of the valve closure member 30 reduced to allow the outer portion of the insert 50 to deform upward. The outer radius of the valve closure member 30 is smaller than the outer radius of the valve seat member 20. In FIG. 8, the difference in the outer radii of the valve closure member and the valve seat member is approximately equal to half the width of the insert. The top portion 35 of the valve closure member 30, beyond radius 72, overlaps approximately 50% of the width of the resilient insert 50. Significant insert life improvement can occur with the overlap reduced from 100% in a conventional valve apparatus to about two thirds of the insert width. It is preferable to decrease the overlap to about 50% or less of the insert width. FIG. 8 illustrates the principle applied to a valve apparatus with a tapered-offset insert as illustrated in FIG. 4.

FIG. 9 illustrates the deformation of the insert 50 when the valve apparatus of FIG. 8 is closed. Percentage deformation of the outer portion of the insert, at radii greater than the radius of the extension 35, is decreased as the total deformation of that portion of the insert 50 is spread over a larger volume of the insert material. The outer portion of the valve insert is allowed to flex upwards rather than being forced to bulge out between the valve closure member and valve seat member as seen in FIG. 7 above. Percentage deformation of the inner portion of the insert under the valve closure member top extension 35 is not significantly changed by decreasing the outer radius of the top 35 of the valve closure member 30. If this modification of the valve closure member is applied to a valve apparatus with an insert having a tapered-offset, as shown in FIG. 8, then the maximum insert offset occurs at the outer radius of the insert. That part of the insert with the greatest offset benefits most from the modification of the valve closure member.

Figure 10:
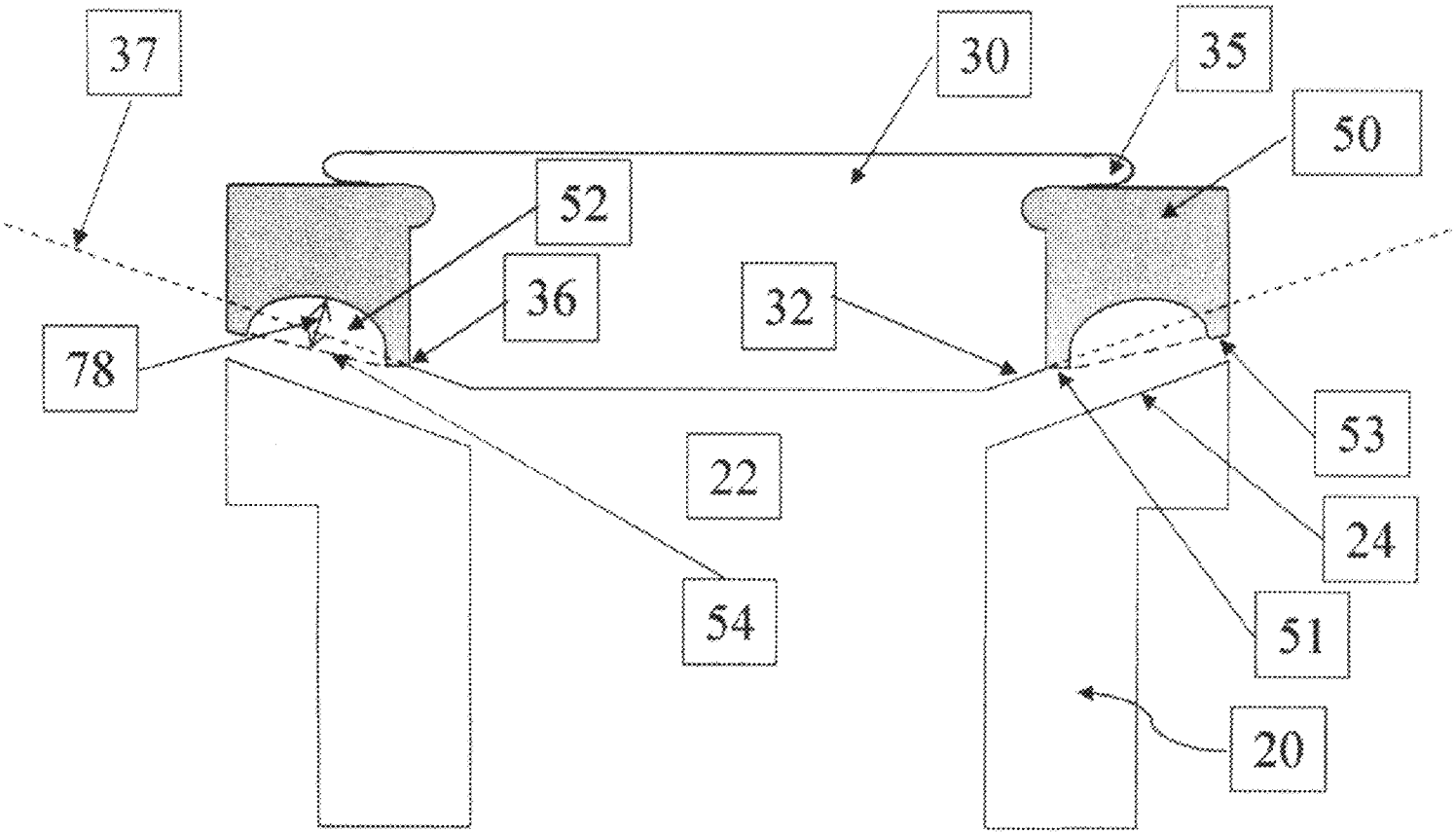

FIG. 10 illustrates an embodiment of the present invention. In this embodiment, a cavity 52 is manufactured in the insert 50. The cavity provides: a) space for proppant particles trapped under the insert upon valve closure, b) a flow of particle-free fluid to flush proppant particles from the space between the frustoconical surfaces 32 and 24, and c) a reduction in the percentage deformation of the inner diameter of the insert 50. The cavity is symmetrical about the central axis of the valve apparatus.

In prior art valves, illustrated in FIGS. 2-9, when the valve closes, insert material contacts all the area of surface 24 that lies below the insert. Cavity 52 prevents insert material from contacting a portion of surface 24 below the insert when the valve is closed.

The cavity 52, illustrated in cross section in FIG. 10, is a concave opening in the bottom of the insert 50. The bottom of insert 50 is divided into two distinct sealing surfaces separated by the cavity. The inner sealing surface 51 is the portion of the bottom surface of insert 50 adjacent to the outer perimeter 36 of the frustoconical contact surface 32 of valve closure member 30. The outer sealing surface 53 of the insert 50 is the portion of the bottom surface of the insert 50, beyond the outer diameter of the cavity.

The straight dashed line 54 extending across below the cavity, from the lowest point on the inner sealing surface 51 to the lowest point on the outer sealing surface 53 of the undeformed insert 50, defines the bottom of the cavity 52. The depth of the cavity is defined as the maximum distance from the bottom of the cavity to the top of the cavity perpendicular to the extension 37 of the frustoconical contact surface 32, when the insert material is not deformed. The depth of the cavity in FIG. 10 is illustrated by the arrowed line 78. The bottom of the cavity is the opening between the inside of the cavity and the fluid flow path through the open valve.

Figure 24:
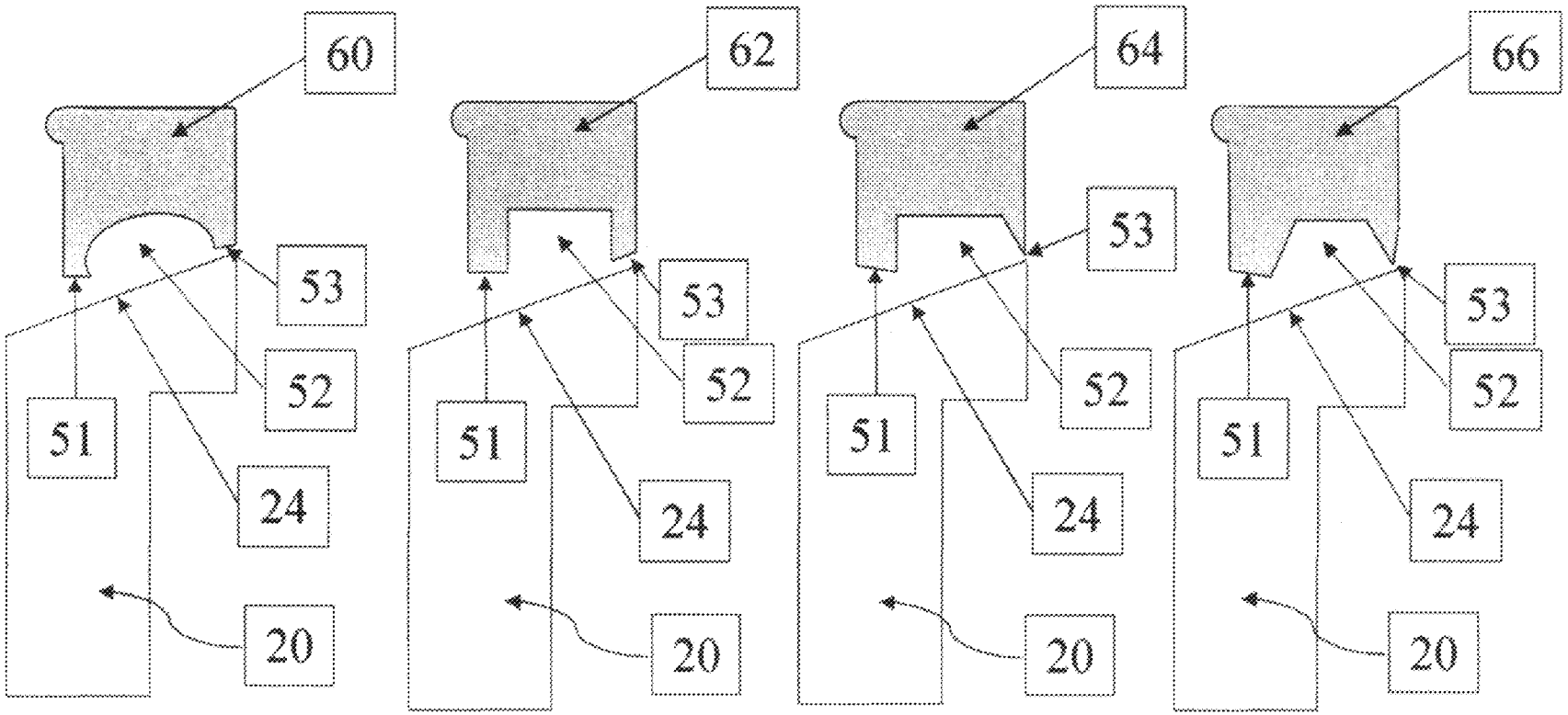

It is preferred, but not necessary, for the cavity to have a generally rounded shape in cross section, such as semi-circular or parabolic, to avoid high stress regions in the resilient insert material. Other cavity shapes can be used, as illustrated in FIG. 24, but sharp corners in the cross section of a cavity are less desirable. Under typical conditions of use, the insert will experience many deformation cycles, and sharp corners in the insert cavity can be stress sites where heat and material fatigue lead to premature failure of the insert material.

The total width of the cavity is defined as the radial distance from the innermost radius of the cavity to the outermost radius of the cavity. In FIG. 10, those radii correspond to the inner and outer radii of the bottom of the cavity. However, in figures below, cavities can extend above portions of the inner and/or outer sealing surfaces. In those cases the total cavity width exceeds the width of the cavity bottom. A large cavity width provides space for particles in slurry trapped under the insert. As will be described below, a large cavity width also provides a large volume of proppant-free fluid to flush the strike face area gap. Total cavity widths should be at least one third of the insert width. It is more desirable for the cavity width to be at least one half the insert width. The preferred cavity width is at least 70% of the insert width.

Cavity 52 in FIG. 10 extends above the extension 37 of frustoconical contact surface 32. The cavity provides space for proppant particles trapped under the insert when the valve closes, without deformation of the insert material beyond the deformation that occurs in the absence of particles. Proppant particles can be trapped in the portion of the cavity above the extension line 37 without deforming the insert when the valve is closed. This is particularly advantageous when pumping slurries of large proppant particles. For 20 mesh proppant, which is commonly used in hydraulic fracturing of oil and gas wells, the cavity depth is normally chosen to be about equal to or greater than 0.066 inches (0.17 cm). For larger proppant, such as 10 mesh proppant, the cavity depth is normally selected to be about equal to or greater than 0.16 inches (0.40 cm) It will be more effective if its depth is enough to extend the cavity above the extension 37 of the contact surface 32. A preferred cavity depth is enough to extend the top of the cavity above the extension 37 by at least the maximum diameter of the proppant particles. For normal proppant sizes of 20 mesh, the preferred cavity depth should extend above the extension 37 by a distance equal to or greater than about 0.033 inches (0.084 cm). For larger 10 mesh proppant particles, the preferred cavity depth should extend above the extension 37 by a distance equal to or greater than about 0.079 inches (0.20 cm).

The offset of the inner sealing surface 51 in FIG. 10 is less than the offset of the outer sealing surface 53. This is evident by comparison with the extension 37 of the contact surface 32. As the valve closes, the outer sealing surface 53 contacts the contact surface 24 of the valve seat 20 before the inner sealing surface 51 contacts surface 24. This provides additional functional advantages for flushing solid particles from the gap between the frustoconical contact surfaces 24 and 32.

Figure 11:
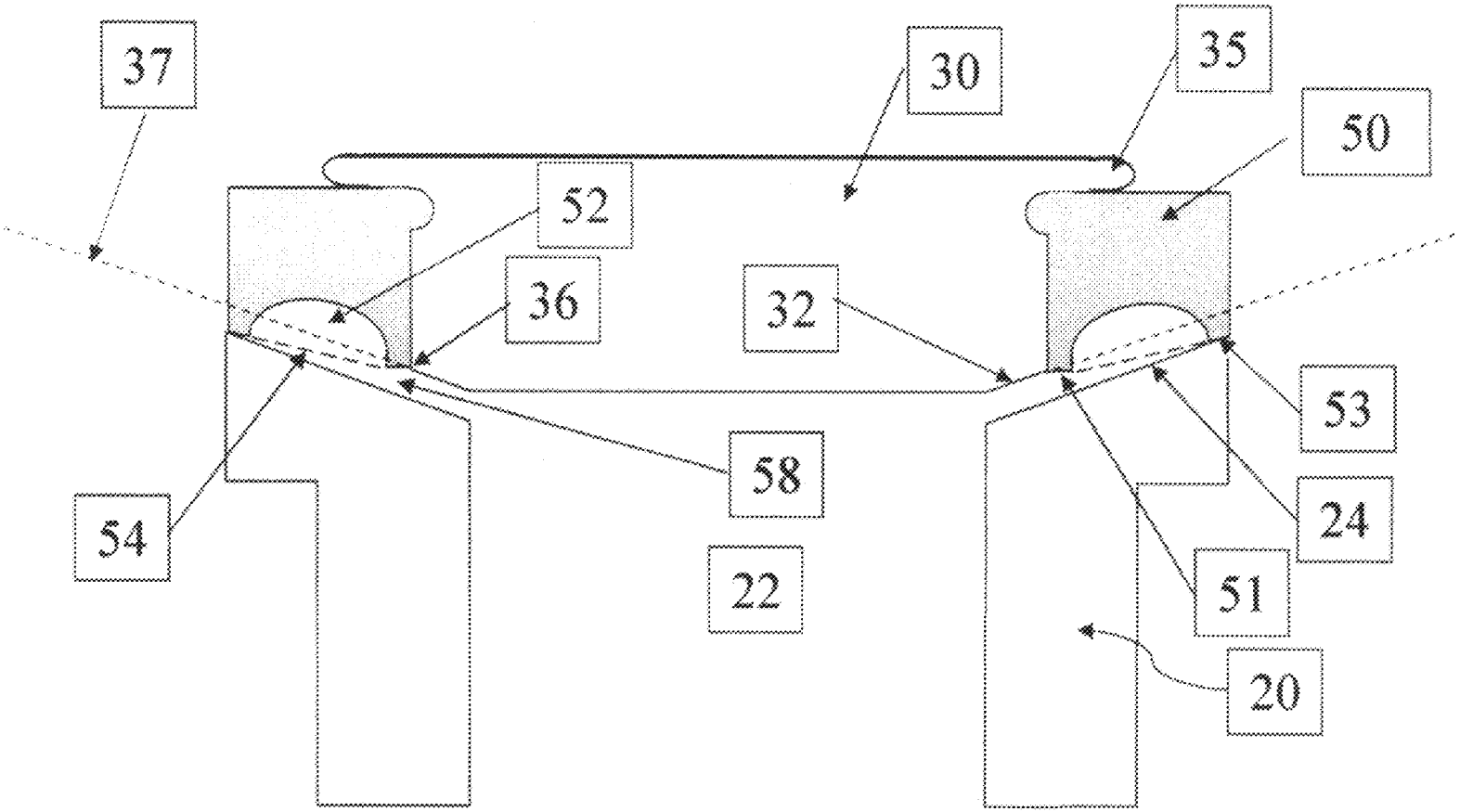

FIG. 11 illustrates the valve apparatus from FIG. 10, when the valve has closed just enough for the outer sealing surface 53 to contact surface 24 of the valve seat 20. A gap 58 exists between the inner sealing surface 51 and the contact surface 24 of the valve seat 20. The width of gap 58 is defined as the minimum distance between the inner sealing surface 51 and the valve seat contact surface 24. For the tapered inner sealing surface 51 in FIG. 11, the minimum distance is from the outer perimeter of the inner sealing surface to the contact surface 24. When the outer sealing surface 53 first contacts the contact surface 24, the width of gap 58 is the difference between the maximum offsets of the outer and inner sealing surfaces 53 and 51 of the insert 50. If that difference between offsets of inner and outer sealing surfaces is greater than the maximum proppant diameter, then proppant cannot be trapped under the inner sealing surface 51, before the outer sealing surface reaches the contact surface 24.

In order to prevent trapped particles from holding the valve open, the outer sealing surface offset must be larger than the maximum proppant diameter, to allow the outer sealing surface 53 to reach the contact surface 24 when there is proppant in the gap between contact surfaces 32 and 24. Accordingly, for 20 mesh particle diameters, the outer sealing surface offset should be at least about 0.033 inches (0.084 cm), and for 10 mesh particle diameters, the outer sealing surface offset should be at least about 0.079 inches (0.20 cm).

It is desirable for the outer sealing surface offset to be greater than the sum of the inner sealing surface offset plus the proppant diameter. That allows the outer sealing surface to contact the valve seat surface 24 before particles can be trapped under the inner sealing surface. For 20 mesh particle diameters it is desirable for the outer sealing surface offset to be at least 0.033 inches (0.084 cm) greater than the inner sealing surface offset.

It is preferable for the outer sealing surface offset to be about equal to or greater than the sum of the inner sealing surface offset plus twice the proppant diameter. Particles in concentrated slurries can be separated from fluid in the slurry when the slurry flows into a gap with width of twice the proppant diameter or less. This separation mechanism can be advantageously used in the present invention to provide a flow of particle-free fluid to flush solid particles out of the gap between the contact surfaces 24 and 32 as the valve closes. For pumping concentrated slurries of 20 mesh particle diameters, the preferred outer sealing surface offset is greater than the inner sealing surface offset by at least about 0.066 inches (0.17 cm). For larger 10 mesh diameters, the preferred outer sealing surface offset is greater than the inner sealing surface offset by at least about 0.16 inches (0.40 cm).

When the valve is closing, after the outer sealing surface 53 contacts surface 24 but before the inner sealing surface 51 contacts surface 24, pressure above the valve is higher than pressures in the cavity 52 and in the hollow bore 22 of the valve seat 20. Differential pressure across the valve produces a downward force on the valve closure member 30. That force deforms the insert 50 and forces the valve closure member 30 toward the valve seat member 20. Resilient material in the outer portion of the insert is deformed as the valve closure member is pressed down. The insert material above the inner sealing surface 51 is not deformed until the valve is closed enough for the inner sealing surface 51 to reach the contact surface 24

There are three distinct volumes above the valve seat contact surface 24. These are a) below the cavity 52, b) below the inner sealing surface 51 and c) below contact surface 32. All three volumes decrease as valve closure member 30 approaches valve seat member 20. Slurry from those decreasing volumes flows inwards toward the hollow bore 22 of the valve seat member 20. If sealing surface 53 fails to make a good hydraulic seal, differential pressure across the valve will still force flow inwards through the sealing surface 53 rather than outwards. The flow from those three decreasing volumes will be inwards toward the hollow bore 22 of the valve seat member 20, even if sealing surface 53 fails to seal completely. This can be exploited to provide a larger volume of clear fluid without proppant particles to flush the valve.

The size of insert gap 58 between inner sealing surface 51 and contact surface 24 decreases as the valve continues to close. Proppant particles too large to enter the insert gap 58 are trapped in cavity 52. Due to the offset of the inner sealing surface 51, the insert gap 58 is narrower than the gap between the contact surfaces 24 and 32. Any particle small enough to enter the insert gap 58 can also pass through the gap between the contact surfaces 32 and 24. After the valve closes enough to make the insert gap 58 narrower than the proppant particles' diameter, the insert gap 58 separates proppant particles from the flowing slurry and traps the proppant particles in the cavity 52. Fluid without proppant particles is forced from the cavity and flows through the insert gap 58 towards the hollow bore 22 of the valve seat 20. This fluid, without proppant particles, flushes proppant particles from the gap between contact surfaces 24 and 32.

Proppant particles are prohibited from entering the insert gap 58 when the gap width is equal to or less than the proppant diameter. Proppant particles are screened from slurry entering the narrow gap. Some screening of particles from a slurry occurs before the gap width is reduced to the proppant particle diameter. The particles have to enter the gap, and particles in a slurry interfere with each other rather than flow smoothly into the gap. For concentrated slurries, separation of particles from fluid occurs when entering a gap of width approximately equal to twice the particle diameter. Therefore, the volume of fluid without proppant that flows through the gap 58 is greater than the volume calculated using a gap width equal to the proppant diameter.

Particles within a flow channel of uniform width that decreases with time, such as the channel between contact surfaces 32 and 24, do not interfere with each other in the same manner as particles entering a gap. Particles already within a closing gap will flow freely through the gap, until the gap width equals the particle diameter.

Fluid without proppant particles flushes proppant particles from the gap between contact surfaces 32 and 24 from the time that gap 58 closes enough to exclude proppant from the fluid until the time when the larger gap between contact surfaces 24 and 32 becomes as small as the proppant particle diameter. During that time interval, the volume of fluid without proppant particles that flushes proppant particles out of the gap between contact surfaces 32 and 24 is at least equal to the projected area under the insert, inward from the outer sealing surface 53, multiplied by the maximum offset of the inner sealing surface 51 from the projection 37 of the contact surface 32. To ensure that all or substantially all of the proppant particles are flushed out of the gap between contact surfaces 32 and 24, the volume of fluid pumped without proppant particles should exceed the volume of the gap between contact surfaces 32 and 24 when proppant particles are first excluded from the fluid entering the insert gap 58.

The critical area for particle-induced damage to the valve closure member and insert is near the strike face outer perimeter 36, the interface between contact surface 32 and the insert. This is the first area from which particles are flushed by particle free fluid pumped from under the cavity. Even if the volume of particle free fluid is insufficient to clear particles from the entire volume between contact surfaces 32 and 24, the volume between those surfaces and near the perimeter 36 is flushed free of particles.

The design of the valve apparatus of the present invention addresses problems previously associated with pumping slurries containing large proppant particles. This is a surprising benefit. The design of the present valve apparatus provides a mechanism for flushing proppant particles out of the valve strike face area essentially without regard for the particle size. The service life of the valve closure member 30 and the valve seat member 20 are thereby significantly increased.

Figure 12:
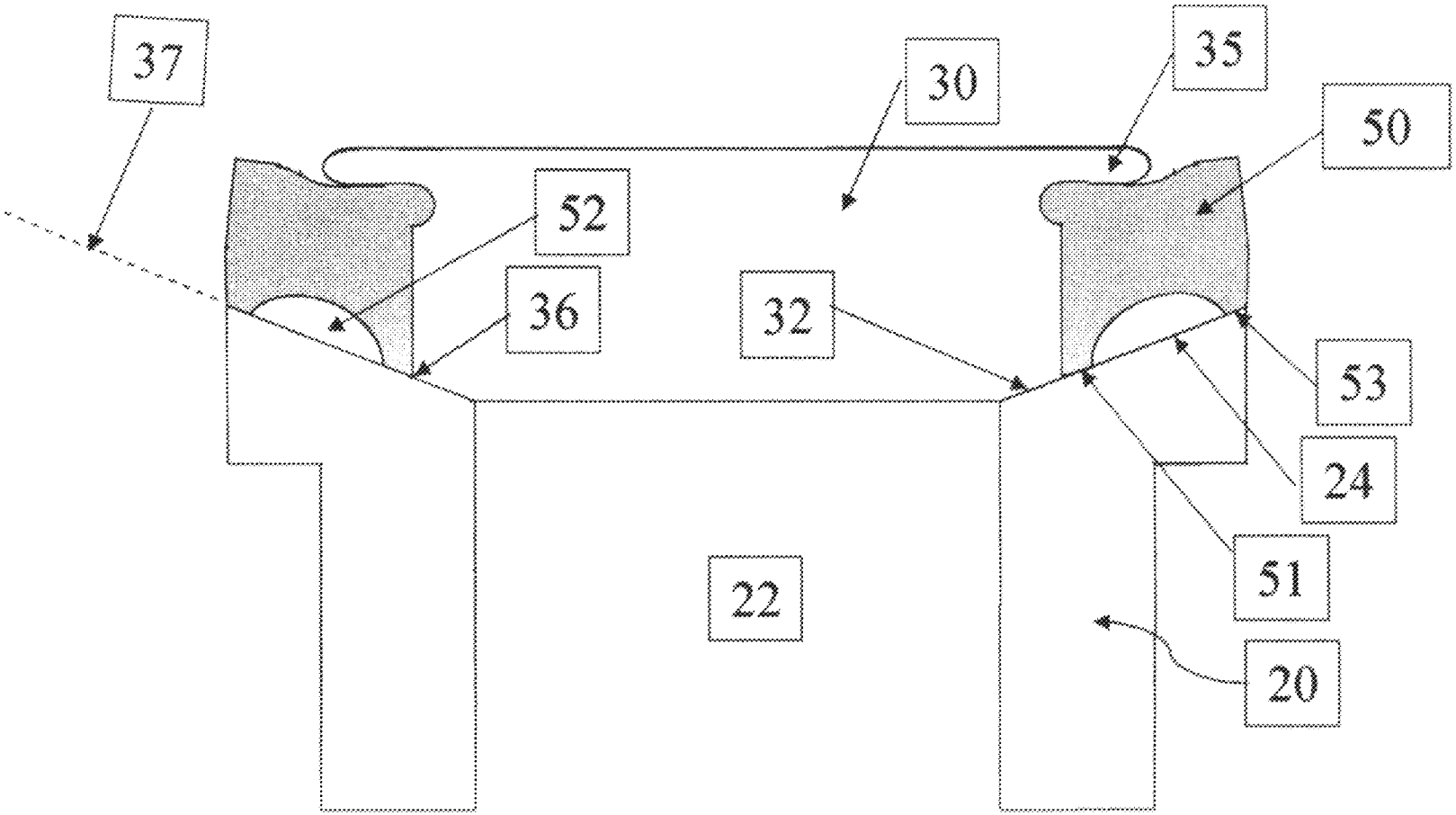

FIG. 12 illustrates the valve apparatus from FIG. 10 after it has closed and surfaces 24 and 32 are in contact. The portion of the insert 50 outwards from the cavity 52 has a large offset to make the initial seal with surface 24 in the presence of proppant particles. When the valve closes, the outer portion of the insert flexes upward. The total deformation of the insert material due to that large offset is spread over the insert material between the outer insert diameter and the outer diameter of the extension 35 of the valve closure member 30. This results in a small percentage deformation of insert material. The smaller offset of the inner portion of the insert 50, inwards from the cavity 52, results in a small percentage deformation of the insert material above sealing surface 51 when the valve is closed.

Deformation of the insert decreases the cavity volume, and fluid trapped in the cavity is pumped in reverse direction through the gap (flow channel) between contact surfaces 32 and 24 before the inner sealing surface 51 contacts the contact surface 24.

The illustration in FIG. 12 does not show proppant particles, but it is evident that proppant particles having a diameter less than half the depth of the undeformed cavity can fit in the insert cavity 52 of the closed valve without deforming the insert or embedding proppant particles into the insert. During each successive cycle of the pump, slurry flowing through the valve apparatus will displace proppant particles concentrated in the cavity volume during the preceding pump cycle.

It is common practice to pump slurries of proppant particles with proppant volume fractions up to approximately one-third. If the proppant particles are spherical and of uniform size, they can theoretically be concentrated up to a volume fraction of about two-thirds, based on the maximum packing factor for spheres. If the insert gap 58 screens proppant particles from an initial slurry with solids volume fraction one-third, and the particles are concentrated in the cavity as a concentrated slurry with solids volume fraction two-thirds, then the volume of concentrated slurry in the cavity with the valve in the closed position of FIG. 12 is equal to half the volume of the original slurry trapped under the insert when the screening of proppant particles began. If the cavity volume is equal to or greater than that volume of concentrated slurry, no deformation of the insert material will occur due to the presence of proppant particles in the cavity when the valve closes. A volume of fluid without particles equal to half the original cavity volume will have been pumped back toward the valve seat throat. The concentrated slurry will be displaced from the cavity during the next plunger stroke.

The percentage deformation of insert material near the inner sealing surface 51 can be low because the offset of the inner sealing surface does not have to be as large as proppant particle diameters for the valve to seal initially. The initial sealing is accomplished at the outer sealing surface 53. This is particularly important for pumping fracturing fluids containing large diameter proppants.

Figure 13:
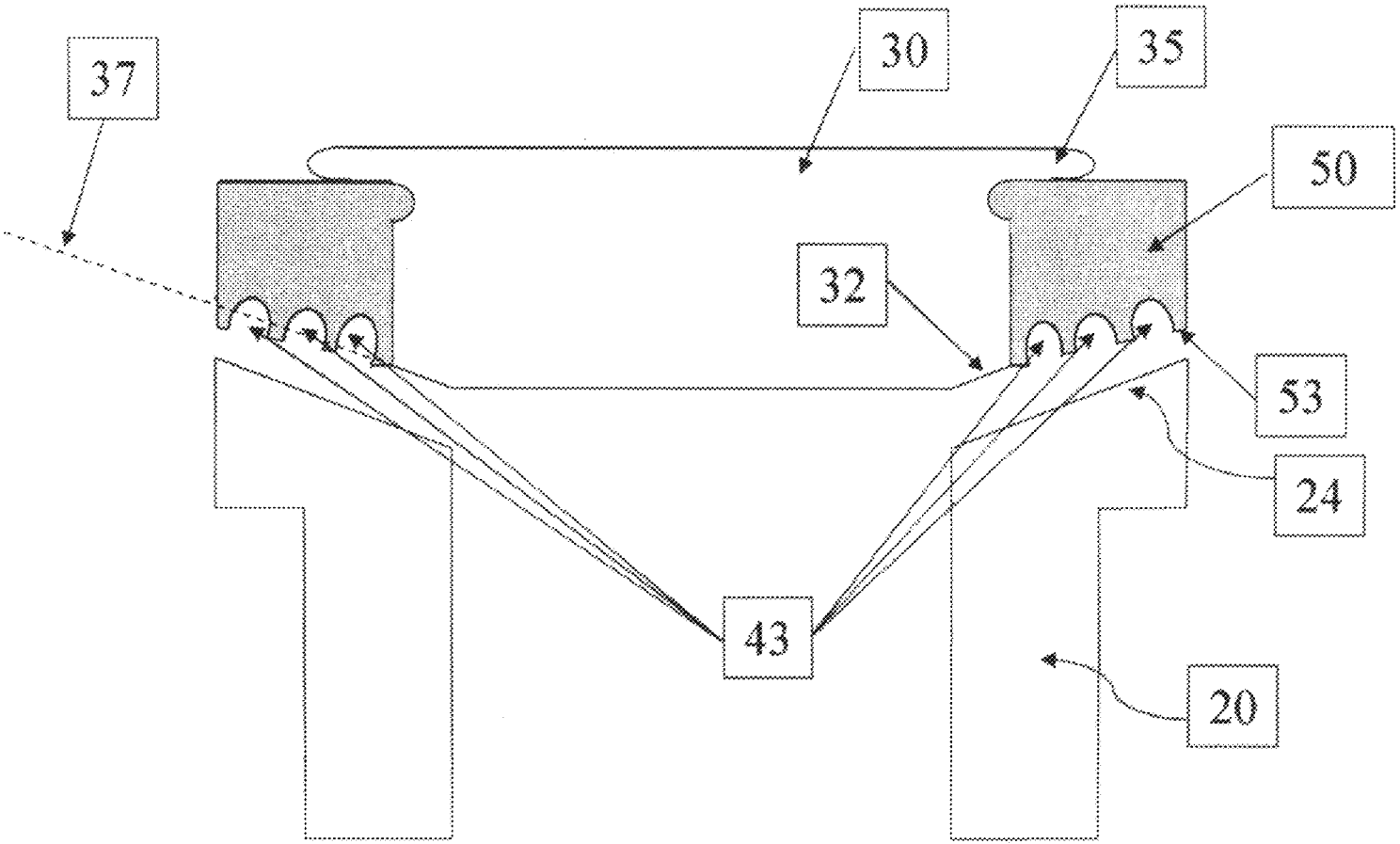

FIG. 13 illustrates another embodiment of the present invention in which the cavity 52 from FIGS. 10-12 is replaced by multiple concentric cavities 43. The insert 50 with cavities 43 functions as the insert with a single cavity 52 in FIGS. 10-12. The outer sealing surface 53 of the insert 50 makes the initial seal with the valve seat surface 24, and the innermost sealing surface of the insert, inwards from the innermost cavity, makes the last seal with the valve seat surface 24 as the valve closes. The use of multiple cavities has an advantage over a single cavity. Multiple cavities provide a succession of sealing surfaces, but the cavities are smaller and they accommodate a smaller volume of concentrated slurry and may not be completely flushed out by flowing slurry during the next plunger stroke.

The two intermediate sealing surfaces of the insert in FIG. 13 are shown in this configuration with insert offsets increasing monotonically with diameter. This provides a sequence of proppant screening from the outer cavity inwards and removes more proppant from the fluid flowing toward the hollow bore 22 of the valve seat 20. The monotonically increasing insert offsets represents a preferred configuration for inserts having multiple cavities, but is not necessary for the basic design to function.

When an insert having a plurality of concentric cavities is used in the present invention, as illustrated in FIG. 13, the total cavity width is defined as the sum of the individual cavity widths.

The cavities in FIG. 13 all extend above the extension line 37 from the frustoconical contact surface 32 of valve closure member 30. The cavities provide space for proppant particles screened from the slurry without increasing insert deformation. These cavities will accommodate proppant particles trapped under the insert when the valve closes, without the particles causing deformation of the insert material. That is a preferred configuration, but is not necessary for the basic design to function. The depth of the cavities could end short of the extension line 37. However, for maximum effectiveness, the cavity depth should be enough to extend the top of the cavity above the extension 37 by at least the maximum diameter of the proppant particles.

The discussion of cavity depths in the description of FIG. 10 above applies also to the cavities in FIG. 13.

Figure 14:
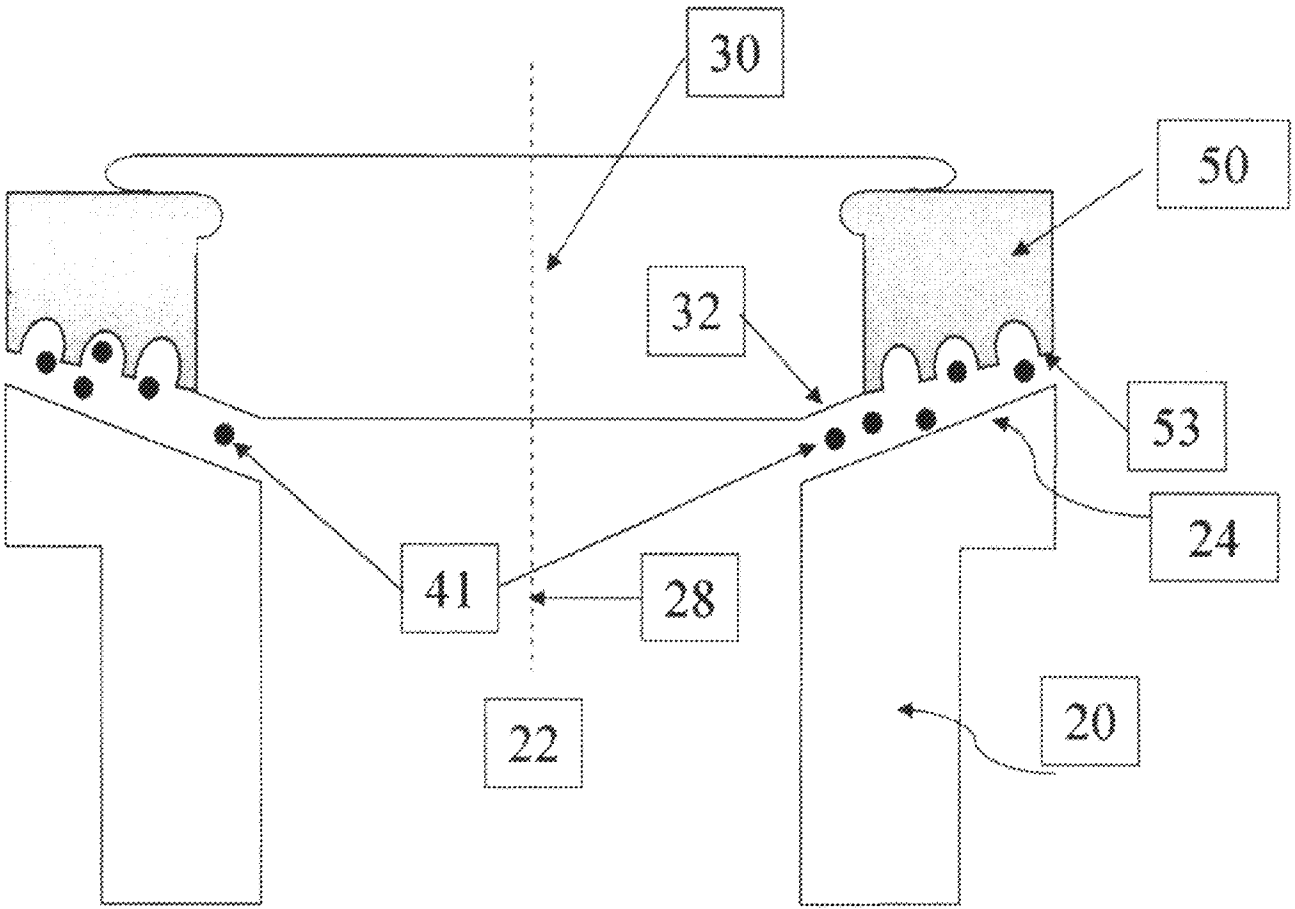
Figure 15:
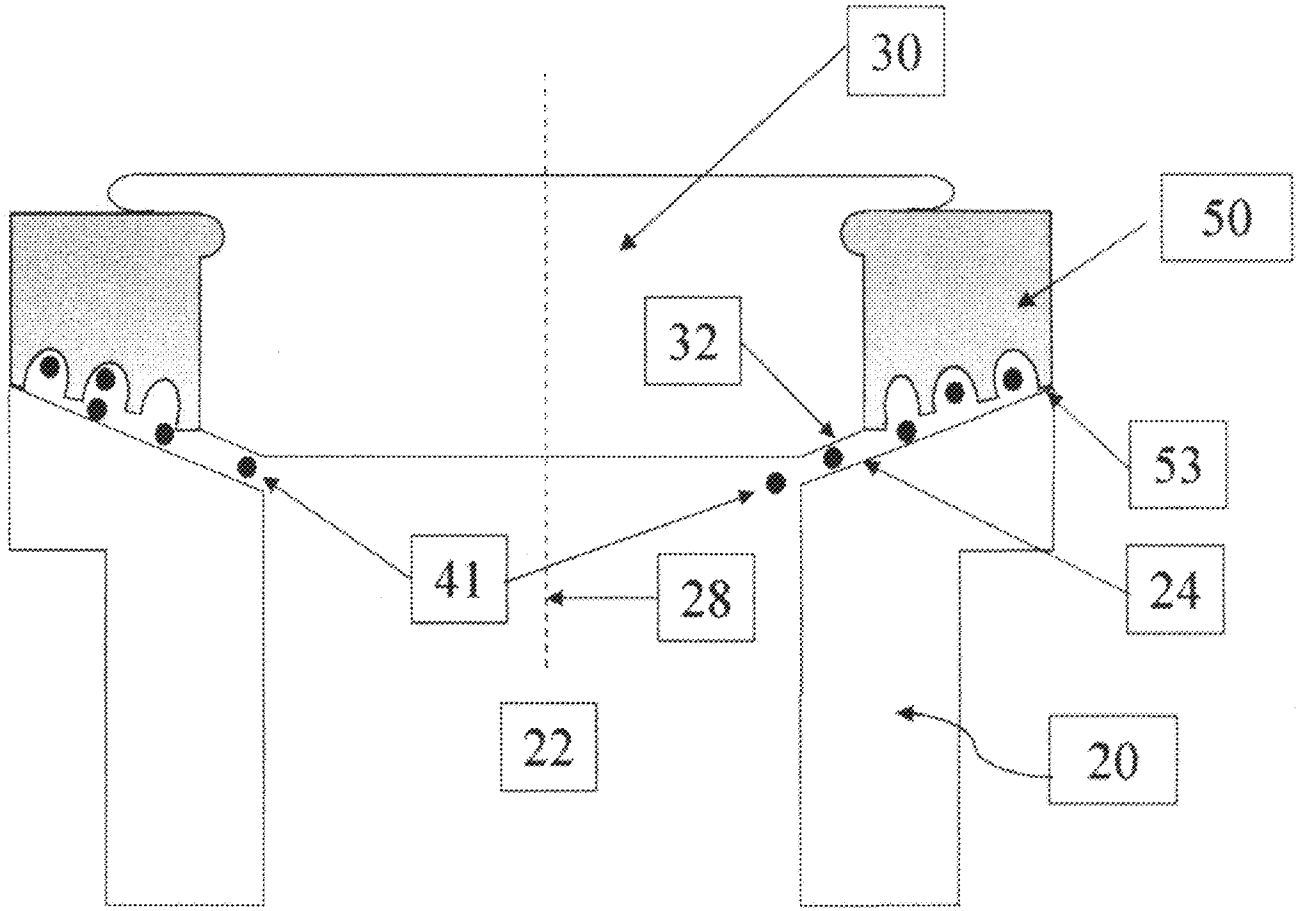
Figure 16:
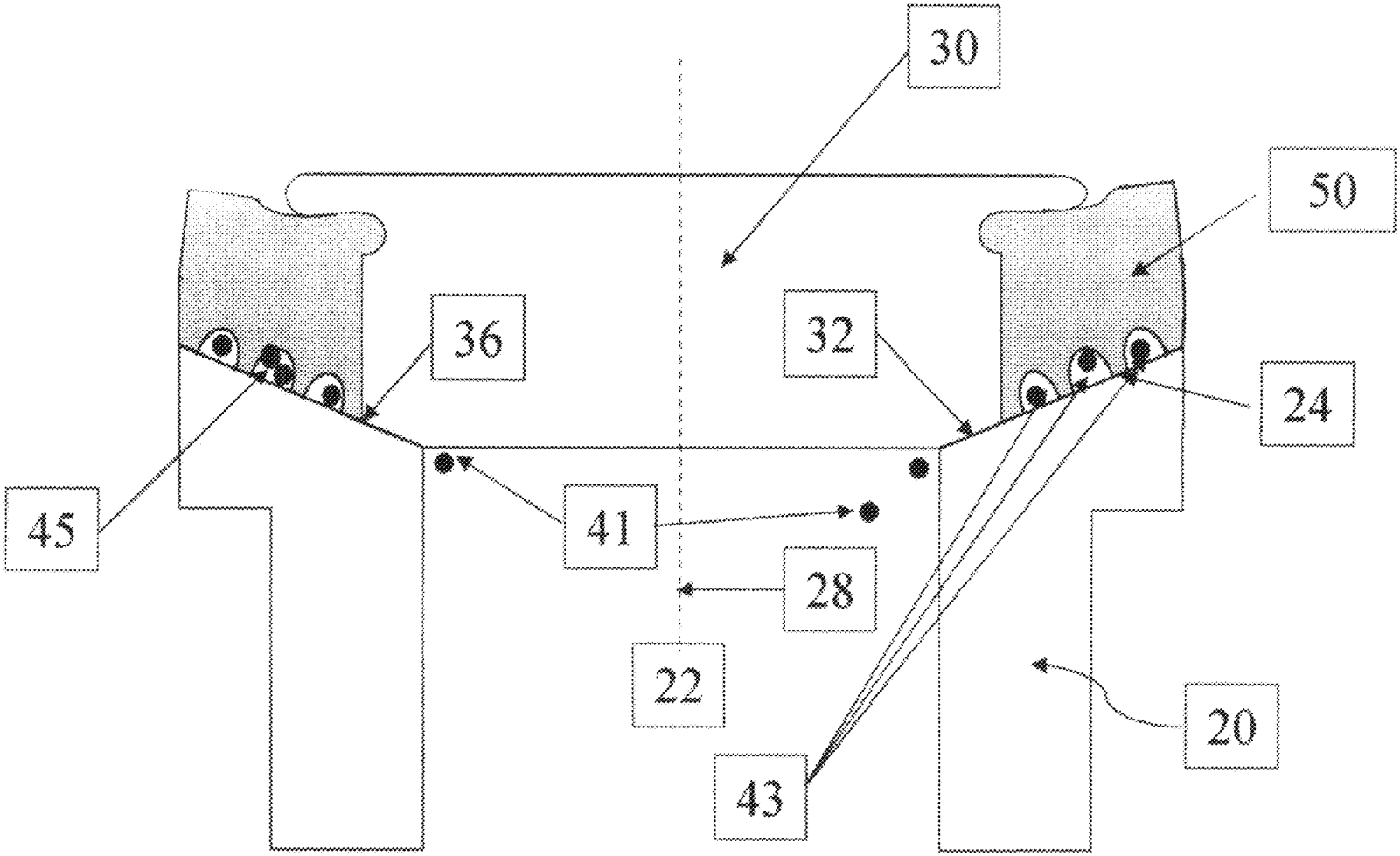

FIGS. 14 to 16 illustrate the valve apparatus design of FIG. 13 closing in the presence of proppant particles 41. The proppant particles 41 in these figures are the same size as the ones used to illustrate the problems of conventional valve inserts in FIGS. 6 and 7. The valve in FIG. 14 is closing while pumping a slurry containing proppant particles 41. Proppant particles are distributed randomly in the slurry flowing through the fluid flow path, above the contact surface 24 of the valve seat member 20 and below the valve closure member 30 and the insert 50. The cavities illustrated in this cross section drawing have cylindrical symmetry about the central axis 28 of the valve apparatus.

FIG. 15 illustrates the valve apparatus of FIG. 13 at the point when the valve is closing and the outer sealing surface 53 of insert 50 initially contacts the valve seat member 20 at or near the outer perimeter of the valve seat member. The insert affects a hydraulic seal along its outer perimeter. As the valve closes further, slurry is forced to flow in reverse direction through the valve toward the hollow bore 22 of the valve seat member 20. The other sealing surfaces of the insert have not yet contacted the valve seat member in FIG. 15. Proppant particles larger than the insert offsets of the insert sealing surfaces between the cavities or the inner insert sealing surface are screened from the reverse slurry flow toward the hollow bore 22 of the valve seat member 20. Fluid from which the proppant particles have been screened is forced toward the hollow bore of the valve seat, and that fluid flushes proppant particles from the gap between the contact surfaces 32 and 24. Proppant particles screened from the slurry are concentrated in the cavities.

FIG. 16 illustrates the valve apparatus of FIG. 13 when the valve is fully closed. The insert 50 has been deformed by the applied pressure forces that close the valve. The percentage deformation of the insert material is decreased by allowing the insert to deform upwards as discussed above. Proppant particles 41 are trapped in the cavities 43 or flushed into the hollow bore 22 of the valve seat member 20. In some cavities, the trapped proppant particles are accommodated by the cavity volume without deformation. In other cavities, illustrated by cavity 45, the amount of trapped proppant results in some deformation of the insert. When the valve is closing, proppant particles trapped in slurry in the cavities will move locally within the cylindrical cavities to minimize local deformation of the insert. During successive cycles of the valve, the concentrated slurry is swept from the cavities by the flow of slurry through the valve. Generally, the slurry is pumped at high velocity through the valve and such high velocity flow is beneficial and preferred.

FIGS. 17-20 illustrate projected areas of contact between the contact surface 24 of the valve seat member and the contact surface 32 of the valve seat member 30, and areas of contact between the contact surface 24 of the valve seat member and the insert 50. All areas illustrated are for the valve in the completely closed position.

Figure 17:
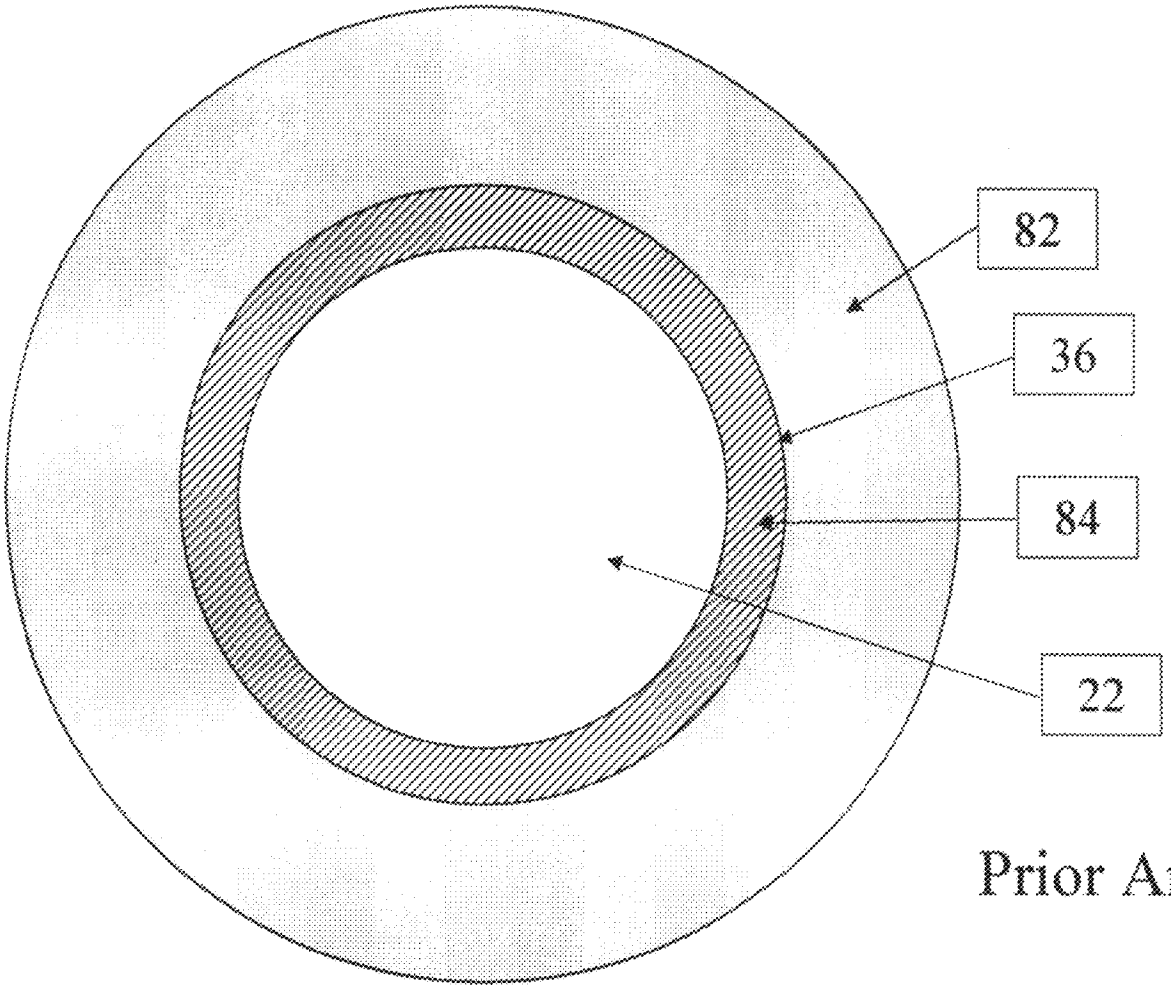
Prior Art Figure 17
FIGS. 17-20 are projected views of contact areas between the valve seat member and the valve closure and valve insert members.

FIG. 17 illustrates contact areas for the prior art valve in closed position, illustrated in FIG. 5. Area 84 is the contact area between the frustoconical contact surface of the valve closure member and the frustoconical contact surface of the valve seat member. Area 84 extends from the outer perimeter of the hollow bore 22 of the valve seat member 20 to the outer perimeter 36 of the frustoconical contact surface of the valve closure member. Area 82 is the area of contact between the insert member of FIG. 5 and the valve seat member of FIG. 5. Area 82 is between the outer perimeter 36 of the frustoconical contact surface of the valve closure member and the outer perimeter of the valve seat member.

Figure 18:
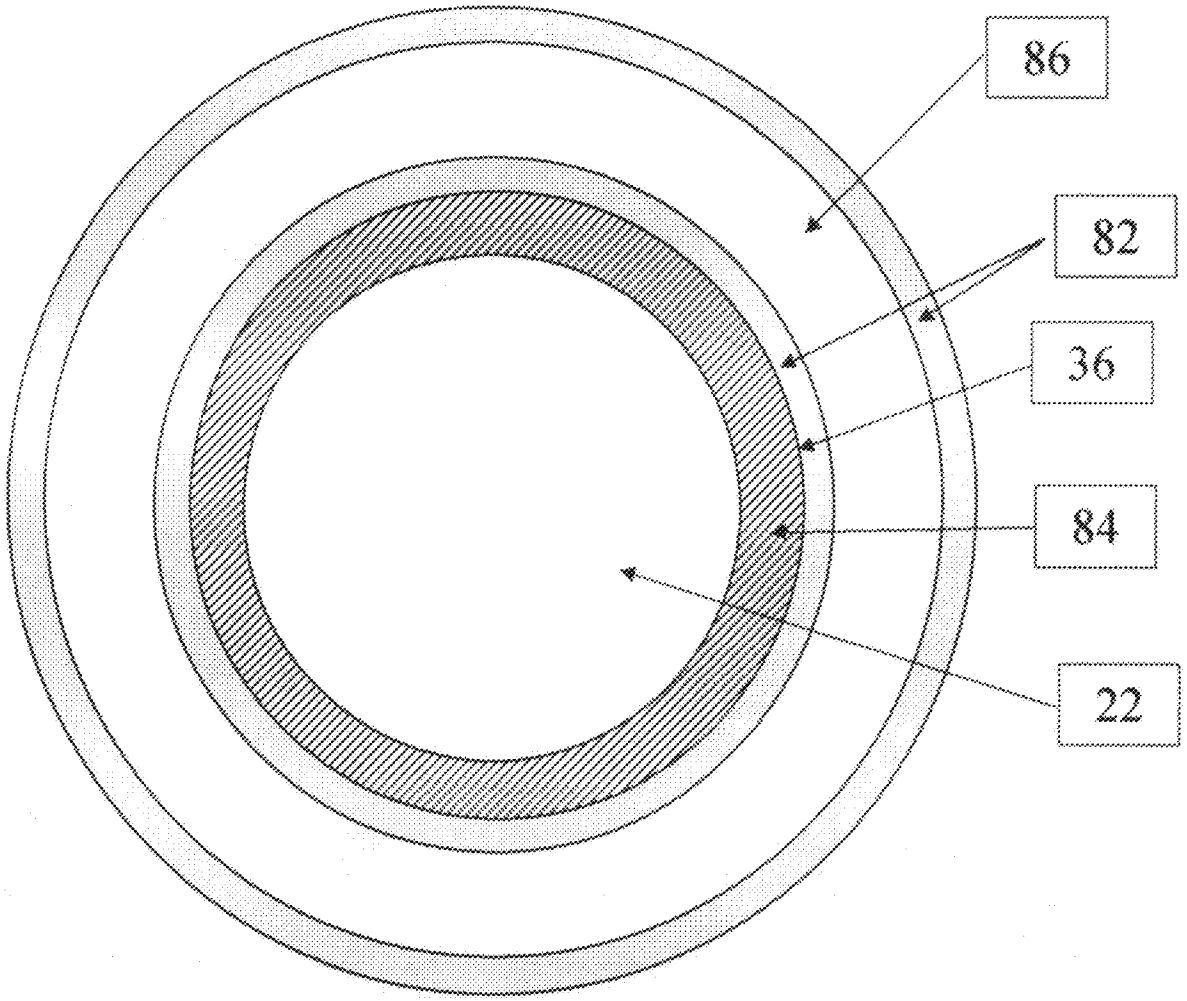

FIG. 18 illustrates contact areas for the embodiment of the present invention illustrated in FIG. 12. Area 84 is the contact area between the frustoconical contact surface of the valve closure member and the frustoconical contact surface of the valve seat member. Area 84 extends from the outer perimeter of the hollow bore 22 of the valve seat, to the outer perimeter 36 of the frustoconical contact surface of the valve closure member. Area 82 is the area of contact between the insert member and the valve seat member of FIG. 12. Area 82 is separated into two circular sections by area 86 in which there is no contact between the valve seat member and either the valve closure member or the valve insert member. Area 86 is the area corresponding to the cylindrical cavity shown in cross section in FIG. 12. The two sections of area 82 represent the contact areas of the inner sealing surface 51 and outer sealing surface 53 in FIG. 12.

Figure 19:
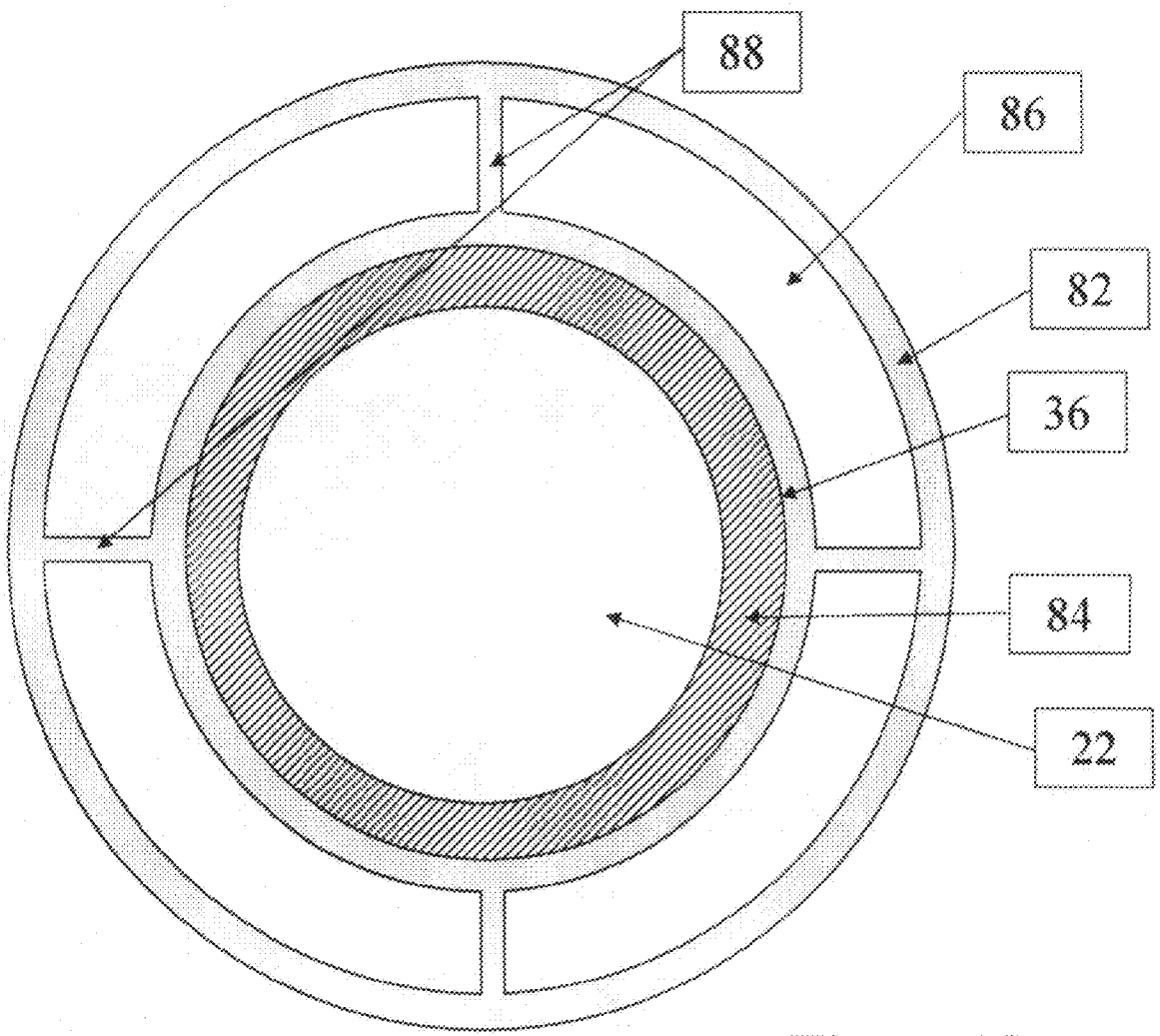

FIG. 19 illustrates the contact areas for another embodiment of the present invention similar to the embodiment illustrated in FIG. 10. In this embodiment, the insert does not have complete cylindrical symmetry. The single cylindrical cavity of the embodiment in FIGS. 10 and 19 is divided into sections by a plurality of narrow webs 88. The webs are narrow to prevent proppant particles from being trapped under them. Area 82 is the area of contact between the insert member and the valve seat member. Area 84 is the contact area between the frustoconical contact surface of the valve closure member and the frustoconical contact surface of the valve seat member. Area 84 extends from the outer perimeter of the hollow bore 22 of the valve seat 20, to the outer perimeter 36 of the frustoconical contact surface of the valve closure member. Area 86 is the projected area of the valve seat that contacts neither the valve closure member nor the valve insert member when the valve is closed. Area 86 in FIG. 19 corresponds to the cylindrical cavity shown in cross section in FIG. 12, minus the areas of the connecting insert webs 88. The connecting insert webs 88 separate or divide area 86 into a plurality of sections.

Figure 20:
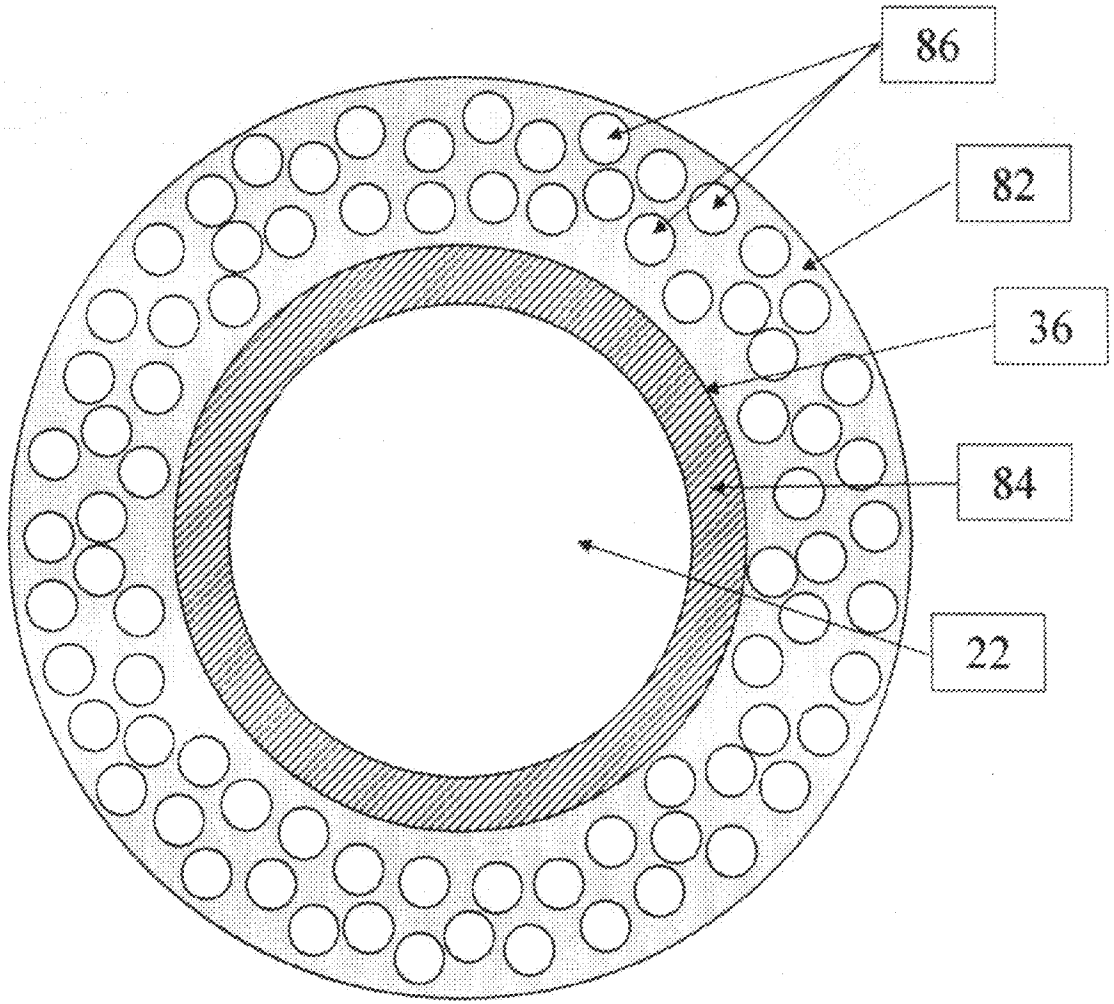

FIG. 20 illustrates the contact areas for another embodiment of the present invention in which the insert cavities do not have cylindrical symmetry but are located in a uniform or random pattern in bottom of the insert. There is a plurality of cavities which result in areas 86 with no contact between the valve seat member and either the valve closure member or the valve insert member. The cavity areas 86 have been illustrated as circular areas. The use of other cavity shapes and sizes, situated in regular or irregular patterns in the bottom of the insert could perform the function of accommodating proppant particles trapped under the insert when the valve closes.

Figure 21:
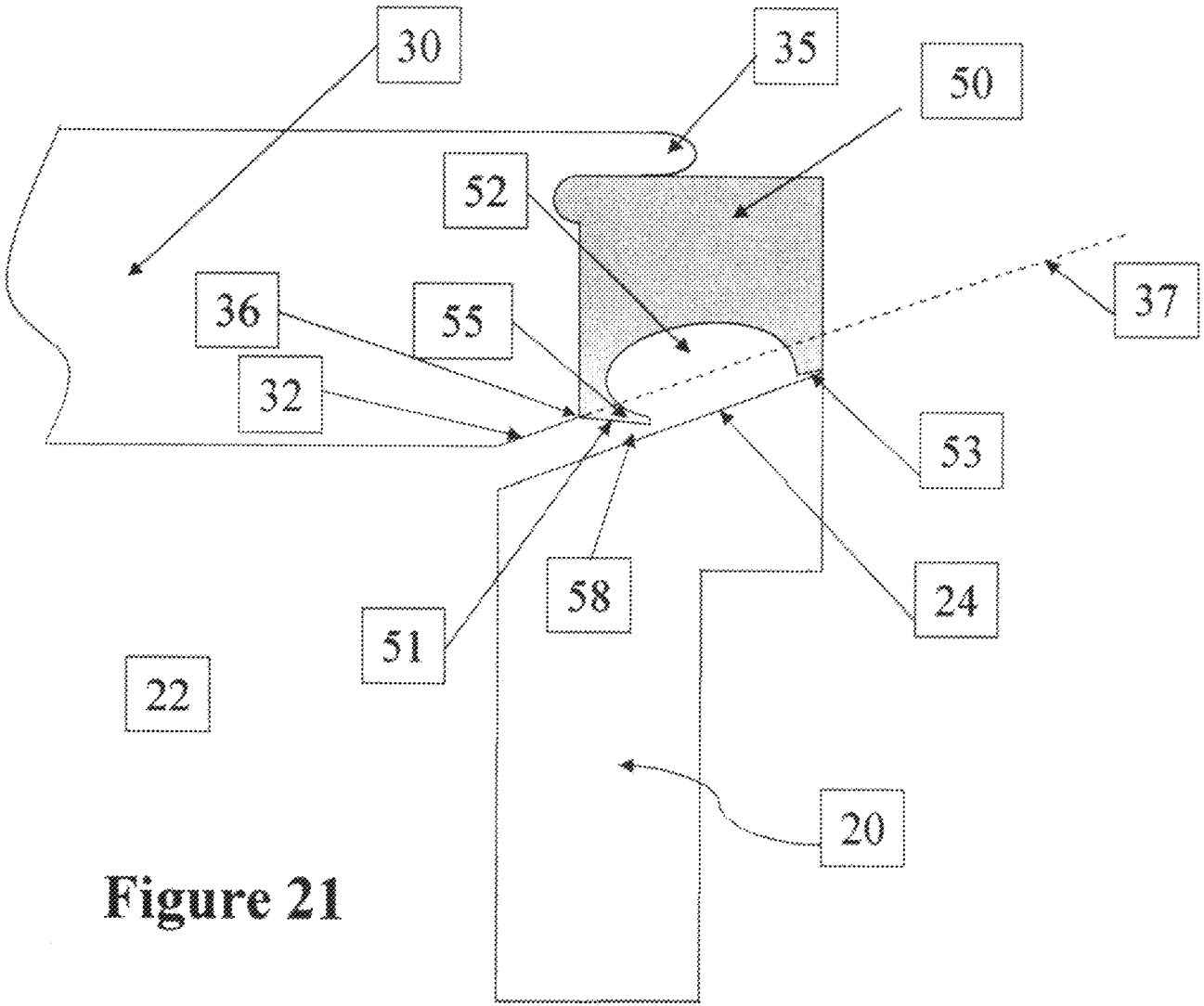
FIGS. 21-29 are cross sectional views of various cylindrical valve apparatus, or portions thereof.

FIG. 21 illustrates an improvement in the insert design of FIGS. 10-12 in which cavity 52 extends radially inward above the inner sealing surface 51, creating a lip 55 of insert material above the inner sealing surface 51 and the volume of the cavity 50. The lip This lip 55 provides a larger inner sealing surface offset without increasing the percentage deformation of the insert material when the valve is closed. The insert material between the inner sealing surface and the cavity can flex upwards into the cavity volume, spreading the total deformation over a volume of insert material. Lip 55 also provides two additional beneficial features: 1) It increases the maximum offset of the inner sealing surface; this increases the volume of clear fluid without proppant particles that flows through the gap between the contact surfaces 32 and 24 before that gap narrows to the diameter of the proppant particles, and 2) it increases the volume of insert material available to form the hydraulic seal at the outer perimeter 36 of surface 32 without decreasing the width of the cavity. The cavity illustrated in FIG. 21 extends inward above the inner sealing surface by an amount approximately 20% of the insert width.

Figure 22:
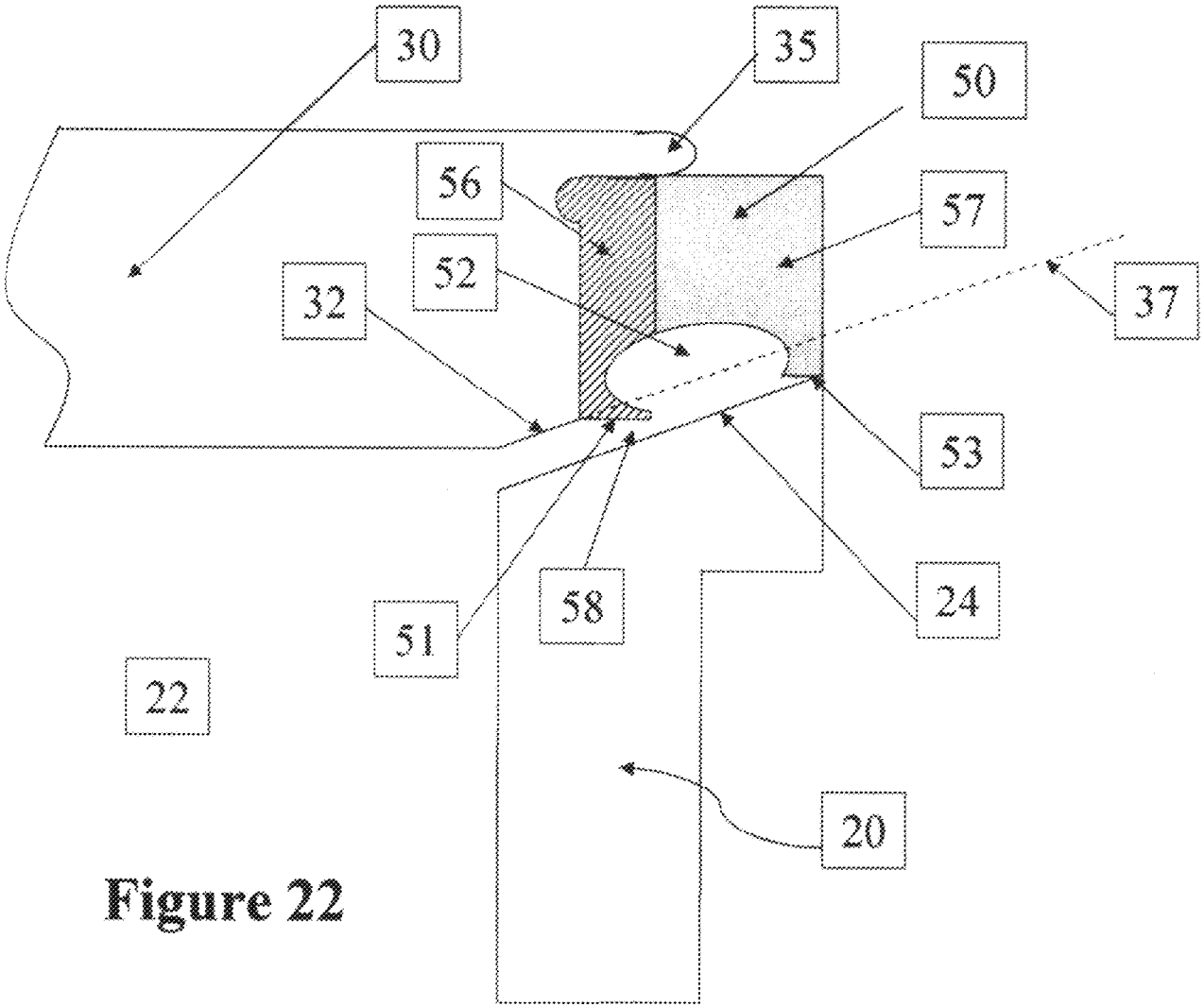

FIG. 22 illustrates the use of an insert 50 comprising regions containing two distinct types of resilient insert materials. The functions and requirements of insert material 56 near the inner seal area 51 are distinctively different from those of the insert material 57 near the outer seal area 53. The inner seal area material 57 may be subjected to extrusion into the gap between the contact surfaces 32 and 24. In the presence of proppant, the width of that gap can be increased, making conditions more difficult for the insert material. The insert material 56 near the inner seal area is therefore advantageously selected to be extrusion resistant.

Insert material 57 near the outer seal area 53, and in the region between the outer seal area and the outer perimeter of the top 35 of the valve closure member 30, is subjected to larger deformations, but is not subjected to extrusion. This material is beneficially selected for properties of elasticity and capability for surviving large repeated deformations. Typically, such materials are softer and more pliable elastomers.

The different operating conditions and materials requirements for the two separate regions indicate that two or more different elastomeric materials can be used to advantage in a composite resilient insert. There are numerous known ways that the two sections, inner and outer sections of a dual elastomer valve insert can be manufactured.

Figure 23:
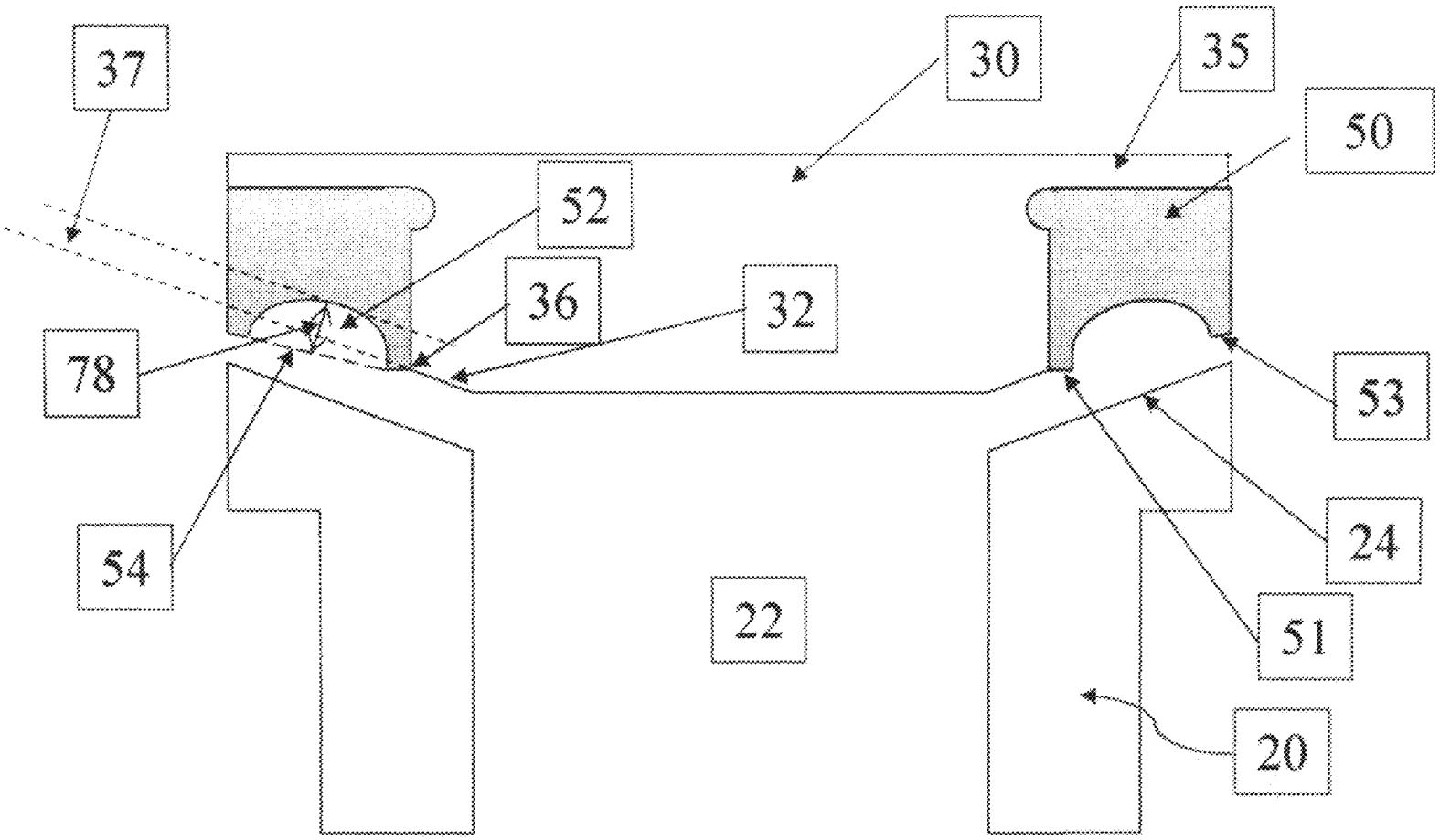

FIG. 23 is the same as FIG. 10, except the top diameter of the valve closure member is approximately the same as the diameter of the valve insert member. The outer portion of the valve insert member is not allowed to deform upwards as shown in FIGS. 10-12. With upwards deformation restricted by the top of the valve closure member, there will be greater percentage deformation of the insert material. However, deformation of the outer portion of the valve insert member is allowed both outwards from the valve and inwards into the cavity space. This decreases the percentage deformation of that insert material compared with conventional prior art insert designs. Deformation of insert material into the cavity space also increases the volume of particle-free fluid pumped out of the cavity to flush the gap between contact surfaces 32 and 24. Reduction of the top diameter of the valve closure member is not required for the basic cavity concept and the embodiments discussed herein to function and pump particle-free fluid out across the strike face area. Reduction of the top diameter of the valve closure member is preferred, however, because it will decrease the percentage deformation of the insert material and thereby lengthen the life of the insert material.

FIG. 24 illustrates some variations in the shape of the cavity 52 in the insert, shown in cross section. Each insert in FIG. 24 is shown with the valve seat member 20. For handling large proppant particles, it is important for the offset of the outer sealing surface 53 of the insert to be larger than the offset of the inner sealing surface 51. Large offsets of the outer seal area will not damage the insert material, because the outer portion of the insert can flex upwards to reduce the percentage deformation required when the valve closes. The offset of the inner sealing surface can remain small to maintain reasonable deformations of the insert material near the critical hydraulic seal area.

Variations in cavity shape can be selected based on performance or ease of manufacturing. Generally, a cavity with rounded shape, such as the cavity in insert 60, will be preferable in operations compared to shapes with sharp corners, because rounded shapes are less susceptible to stress concentrations in the corners causing damage upon repeated deformation.

Insert 62 illustrates a cavity generally rectangular in cross section, which would perform as the insert 60 and could be easier and/or less expensive to manufacture. The outer sealing surface 53 of insert 62 is parallel to the contact surface 24 of the valve seat member 20. This outer sealing surface is like the constant offset insert surfaces in FIGS. 2, 3 and 6. When the valve is closing, contact between surfaces 53 and 24 is made all along surface 53 simultaneously. In such a case, the outer perimeter of the insert is defined as the outer perimeter of the area in first contact with surface 24.

Insert 64 is generally like insert 62, but with the outer sealing surface 53 changed to a point in cross section, designed to ensure that no proppant particles are trapped between the outer sealing surface and the valve seat member 20. The outer sealing surface does not contribute to the hydraulic seal at the outer perimeter of the metal-to-metal contact area of the valve closure member and valve seat member. Therefore, narrowing the outer sealing surface to allow it to move easily downward through slurries does not compromise the hydraulic seal formed by the inner contact surface. Narrowing the outer sealing surface to a point is not necessary. As the surface moves down through the slurry, the slurry is flowing through the gap between the outer sealing surface and the valve seat. The flow direction of the slurry is nearly perpendicular to the direction of the insert's motion. The average velocity of the slurry flow is higher than the downward velocity of the insert through the slurry. An outer sealing surface width comparable to the diameter of the proppant particles is narrow enough to prevent trapping particles under the outer sealing surface.

Having a narrow outer sealing surface to push down through the slurry to contact the valve seat is preferred for situations in which there is enough valve lag for the plunger to start its suction stroke before the outer sealing surface of the insert comes near enough to the valve seat to start screening particles from the slurry. In such situations, the screened particles would be outside and downstream of the valve apparatus.

Insert 66 shows two more separate modifications of insert 62. The point of the outer sealing surface 53 is moved radially inward to contact the valve seat member 20 inward from its outer perimeter. This prevents the outer sealing surface from deforming over the outer perimeter of the valve seat member 20. In this case the outer perimeter of the insert is defined by the outer point of contact surface 53 and is less than the maximum diameter of the insert material. The geometry of the insert material near the inner sealing surface 51 is also changed. The maximum offset of the inner sealing surface 51 is increased, and the insert shape above the outer perimeter of the inner sealing surface 51 is altered.

Figure 25:
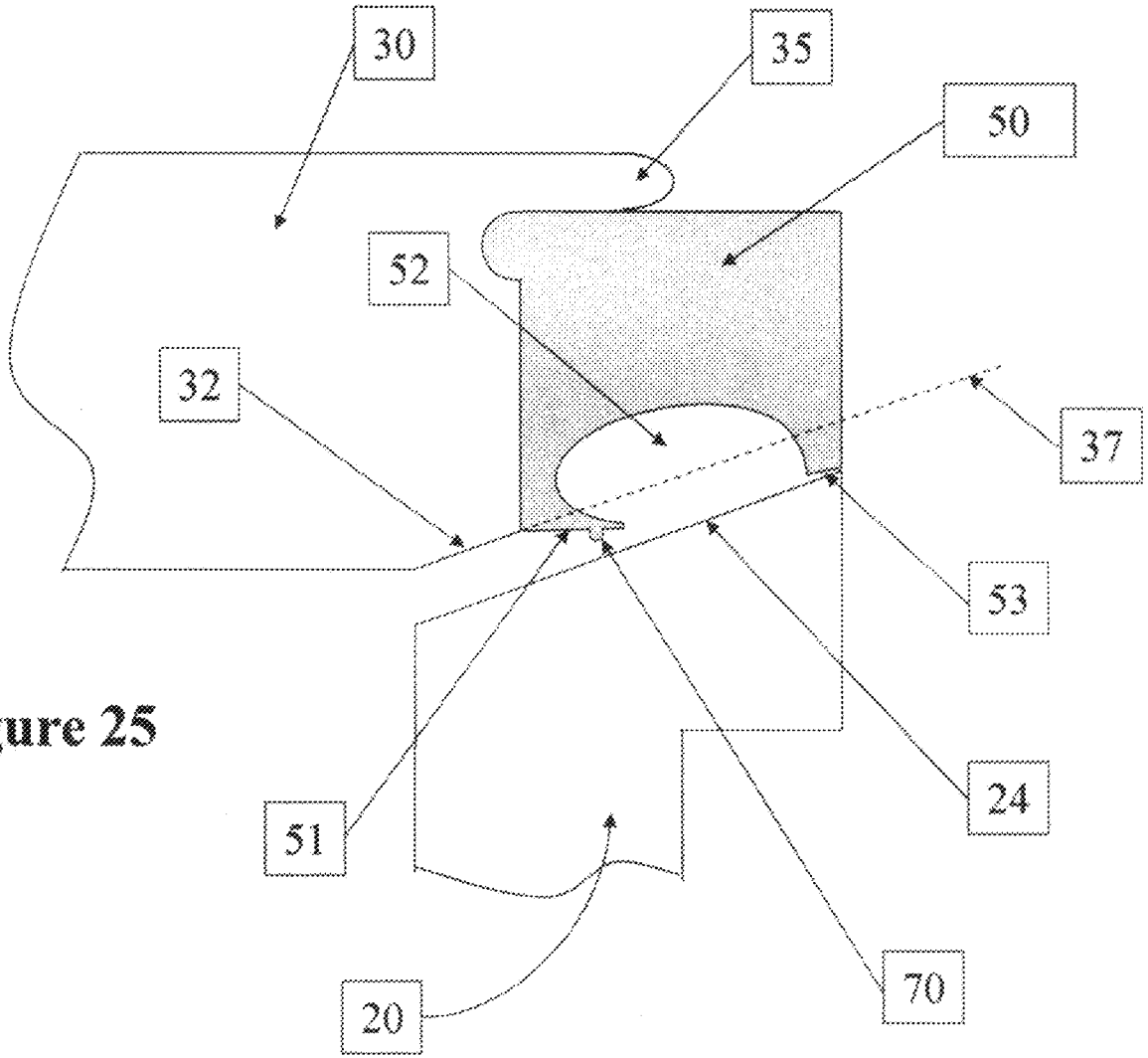
Figure 26:
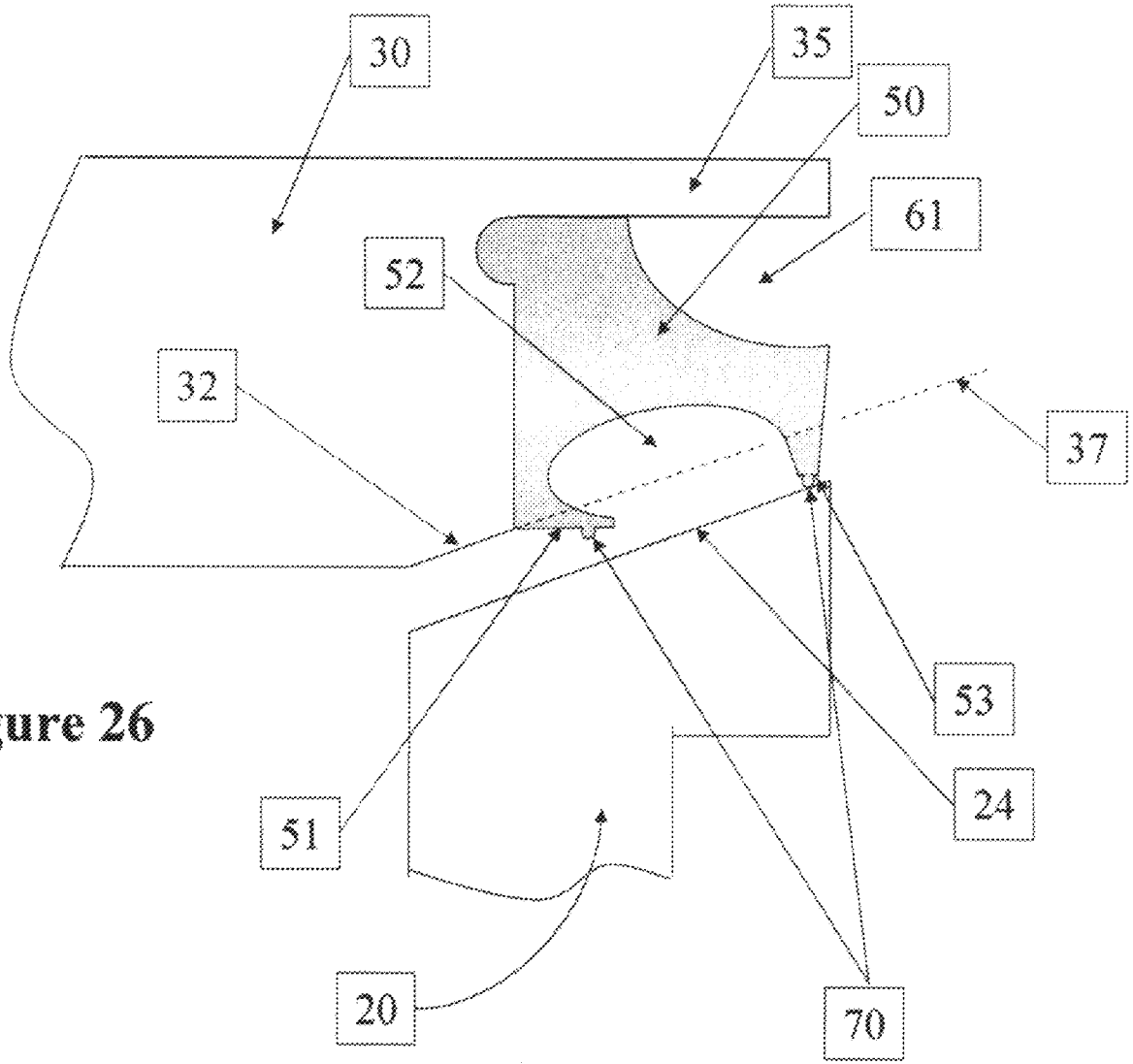
Figure 27:
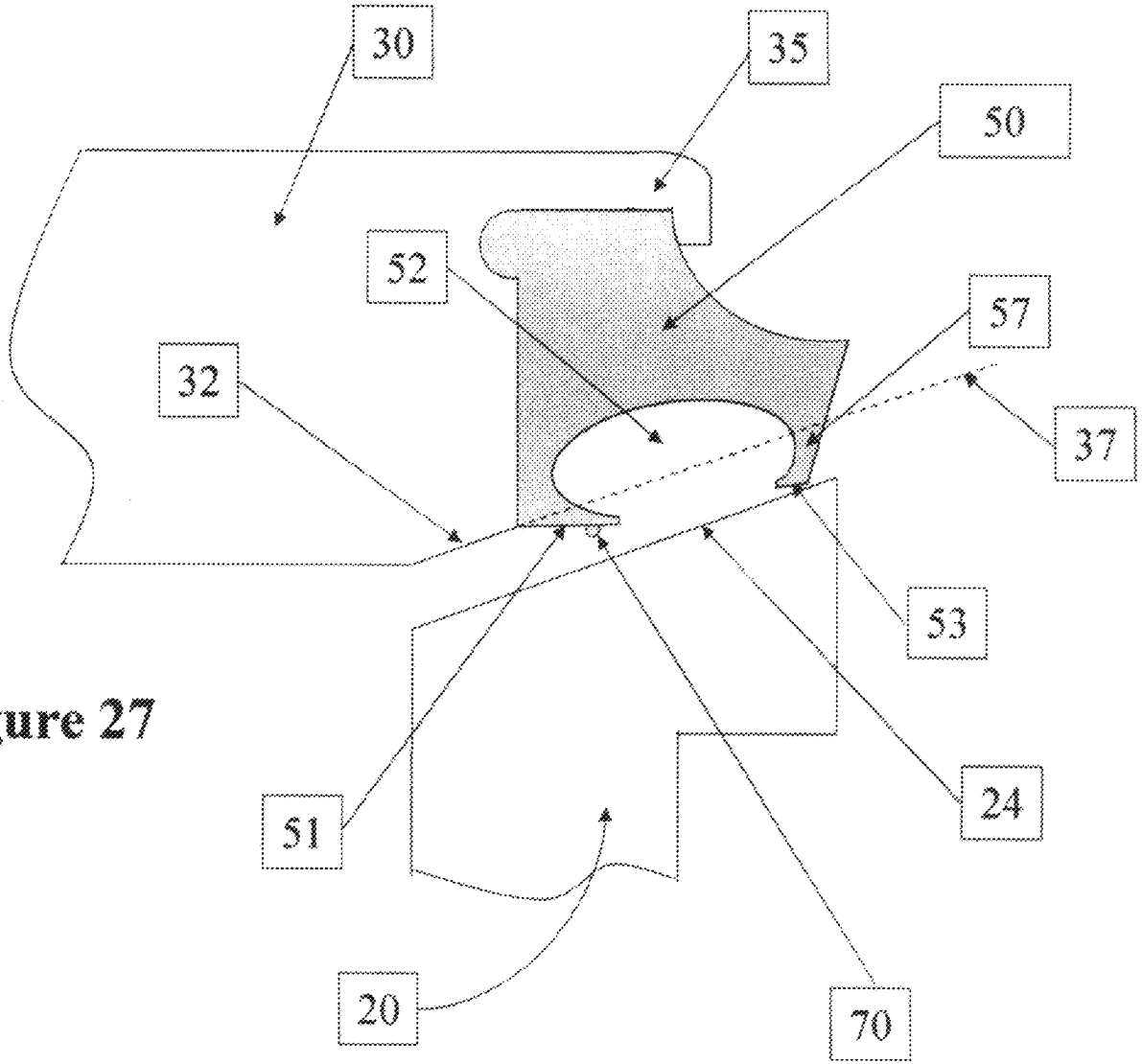

FIGS. 25-27 illustrate a use of protrusions 70 on the inner sealing surface 51 of the resilient insert 50 from FIG. 25. These protrusions provide a screening gap between the inner sealing surface 51 of insert 50 and the frustoconical contact surface 24 of valve seat member 20 to provide a flow of particle-free fluid from inside the valve apparatus to flush particles from the gap between contact surfaces of the valve closure member and the valve seat member before the valve closes. The protrusions hold the inner sealing surface up until sufficient force is applied to deform the insert material.

U.S. Pat. No. 7,000,632 B2, "Valve Apparatus" by McIntire et al. teaches the use of protrusions located specifically around the outer perimeter of the insert sealing surface to provide a flow of proppant-free fluid specifically from downstream of the valve into and through the valve to flush particles from the gap between the contact surfaces 32 and 24. In the embodiment of the present invention illustrated in FIGS. 25 and 27, protrusions are located on the inner sealing surface, and the flow of particle-free fluid comes from the cavity under the resilient insert, rather than from downstream of the valve.

FIG. 26 illustrates a use of protrusions 70 near the outer perimeter of the outer sealing surface 53, similar to the teachings of U.S. Pat. No. 7,000,632, "Valve Apparatus" by McIntire et al. Those outer sealing surface protrusions in FIG. 26 are coupled to the cavity to dilute slurry in the cavity, rather than promoting fluid flow directly to the gap between surfaces 32 and 24. Removal of insert material to create cavity 61 between the outer portion of the insert and the top 35 of the valve closure member 30, allows the outer portion of the insert to flex upwards. This will prolong the life of protrusions 70 on the outer sealing surface 53.

FIG. 27 illustrates a modification the insert 50 to promote deformation of the outer cavity wall into the cavity 52, after the outer sealing surface contacts the valve seat member 20. The cavity 52 extends to a diameter larger than the inner diameter of the outer sealing surface 53. Deformation of the outer cavity wall into the cavity 52 decreases the volume of the cavity as the valve closes and pumps a larger volume of particle-free fluid through the space between the contact surfaces 32 and 24.

FIG. 27 also illustrates generally how the top 35 of the valve closure member 30 can be modified to retain the insert 50 when slurry flows through the valve at high velocities. Unbonded valve inserts can have a tendency to be pumped off the valve closure members in pump discharge valves due to the high velocity slurry flow and the asymmetry of the pump flow channels downstream from the discharge valve. Since the top of the outer portion of the insert in FIG. 27 does not contact the valve closure member, some of the space vacated by modifying the insert can be used for modifying the top 35 of the valve closure member 30 and providing a means to retain the insert.

Figure 28:
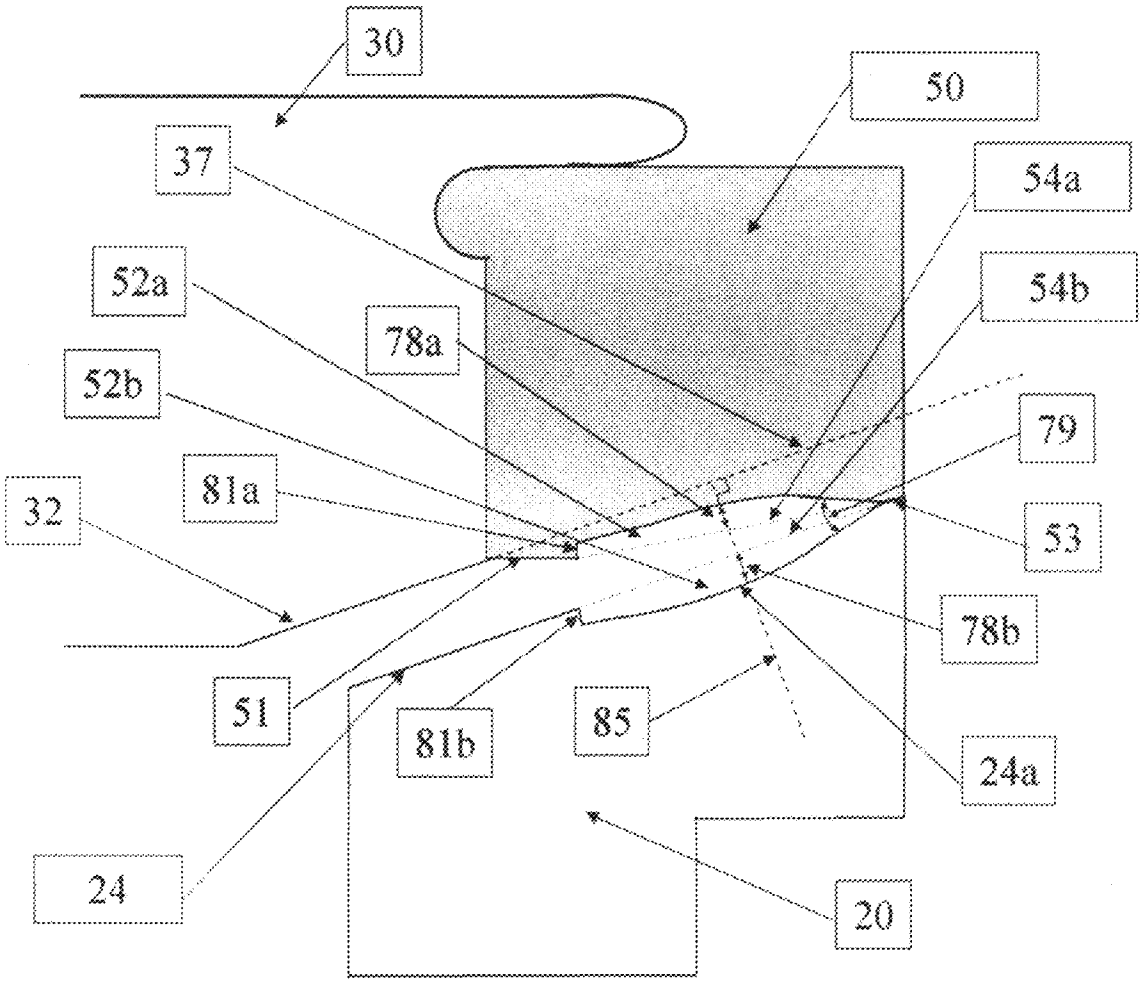

FIG. 28 illustrates an embodiment of the invention in which the cavity with cylindrical symmetry between the valve insert 50 and the valve seat 20 comprises a cavity portion 52*a* in the valve insert 50 and second cavity portion 52*b* in the valve seat 20. Dotted line 54*a* defines the bottom of the cavity portion in the insert, and dotted line 54*b* defines the top of the cavity portion in the valve seat. When the cavity is made of two cavity portions 52*a* and 52*b* as in FIG. 30, the cavity depth is defined as the largest sum of the two cavity portion depths 78*a* and 78*b*, measured perpendicular to the extension 37 of the surface 32, along a perpendicular line such as 85, when the sealing surface 53 contacts the valve seat 20 with no deformation of the insert 50. The two cavity portion depths so measured will not line up when the valve is closed and the insert is deformed, but this definition of the cavity depth involves practical measurements of the valve insert and valve seat, without insert deformation.

In FIG. 28, the two cavity portions taper smoothly toward the valve exit at their outer diameters at the outer sealing surface 53. In FIG. 30, angle 79 between the two cavity surfaces approaching the outer diameter of the cavity portions is approximately 30 degrees. The tapered exit channels particles in a slurry toward the gap between valve and seat before the outer seal 53 contacts the valve seat 20. This promotes passage of particles, as opposed to screening out particles, in slurry flowing through the valve in the forward direction before the valve closes. It is advantageous to prevent proppant from being screened out of slurry flowing in the forward direction and to keep particles from accumulating in the cavity before the valve closes. Angle 79 is generally selected to be about equal to or less than 60 degrees; such angles are effective at channeling particles in slurry leaving the cavity and prevent screening them out of the slurry. Angles of about 45 degrees or less are preferred. Many of the cavities illustrated in FIG. 10 et seq. do not have this tapered-exit feature at their outer perimeters but obviously could be so modified if desired. The tapered cavity exit feature is preferred for situations in which there is not enough valve lag to start the plunger suction stroke before the outer sealing surface of the insert nears the valve seat and starts screening particles form the slurry. In those situations there is a danger of piling up screened particles in the cavity volume. The tapered exit helps to minimize the amount of screened proppant by preventing screening until the gap between the outer sealing surface of the insert and the valve seat approaches the diameter of individual particles.

It is particularly advantageous to have the same inner radius for each of the two cavity portions as illustrated in FIG. 30, and to have an abrupt step 81*a* in surface 24 and an abrupt step 81*b* in surface 51 at that inner radius. The steps provide a barrier to flowing proppant particles with slurry in reverse flow. Particles in slurry flowing in reverse direction out of the valve apparatus are not channeled into the gap between surfaces 51 and 24.

It is well known in the oilfield service industry that proppant particles in a slurry bridge across cylindrical perforations through a wellbore wall when the diameter of the perforation is less than about three particle diameters and the concentration of particles in the slurry approaches or exceeds approximately 20 percent by volume. Cylindrical perforation's diameters must be larger than three proppant diameters for such slurries to be pumped through them successfully.

The abrupt step 81*a* in surface 24 and the abrupt step 81*b* in surface 51, at the inner diameters of the cavity portions in FIG. 28, act in analogy to the pipe wall at the entrance to a cylindrical perforation. In FIG. 28, the opening is not a circular perforation but a slot around the central axis of the valve apparatus at the inner diameters of the cavity portions. Dimensional analysis predicts that particles in a concentrated slurry will bridge across the slot entrance when the slot height is decreased to twice the particle diameter. Thus, with the abrupt steps 81*a* and 81*b* at the inner diameter of the cavity portions, fluid without proppant particles will flow in reverse direction from the cavity through the gap between surfaces 24 and 51 after the valve has closed to make the cavity entrance gap width two particle diameters. The abrupt steps increase the volume of proppant-free fluid that is pumped in reverse flow after the initial seal is made and before the valve closes completely. It is desirable for the size of steps 81*a* and 81*b* to be equal to or greater than half the diameter of a proppant particle. For normal proppant sizes of 20 mesh, this desirable step size is equal to or greater than 0.016 inches (0.042 cm) For larger, 10 mesh size proppant, this desirable step size is equal to or greater than 0.039 inches (0.10. cm) It is preferred for the size of the steps to be equal to or greater than the diameter of a proppant particle. For normal proppant sizes of 20 mesh, the preferred step size is equal to or greater than 0.033 inches (0.084 cm). For larger size proppant, such as 10 mesh, the preferred step size is equal to or greater than about 0.079 inches (0.20 cm).

The advantages of a cavity between the insert and valve seat can be obtained using a cavity in the valve insert alone, or using a cavity in the valve seat alone, or using cavity portions in both the valve insert and valve seat. When the cavity is manufactured in the valve seat alone, the resilient insert material is deformed downwards into the cavity to reduce the cavity volume and pump proppant-free fluid back toward the valve seat throat. Having an abrupt step at the inner radius of the cavity and tapering the cavity near its outer diameter is advantageous for a valve apparatus with a cavity in either the valve insert alone or the valve seat alone.

The configuration illustrated in FIG. 28, with cavity portion 52*a* in the insert and cavity portion 52*b* in the seat, has the advantage of screening out particles from the slurry in reverse flow starting with the valve open further than would be the case for a cavity in either the insert alone or the seat alone.

Another advantage of combining cavity portions in both the insert and the valve seat is that the design provides for a large cavity without having a large disturbance of the flow profile through the valve when the valve is open. Such a disturbance might lead to erosion damage of valve components, especially at high flow rates through the valve and/or when pumping concentrated slurries. The two cavity portions in the insert and seat will also be easier to sweep clear of concentrated proppant during the next plunger stroke.

Figure 29:
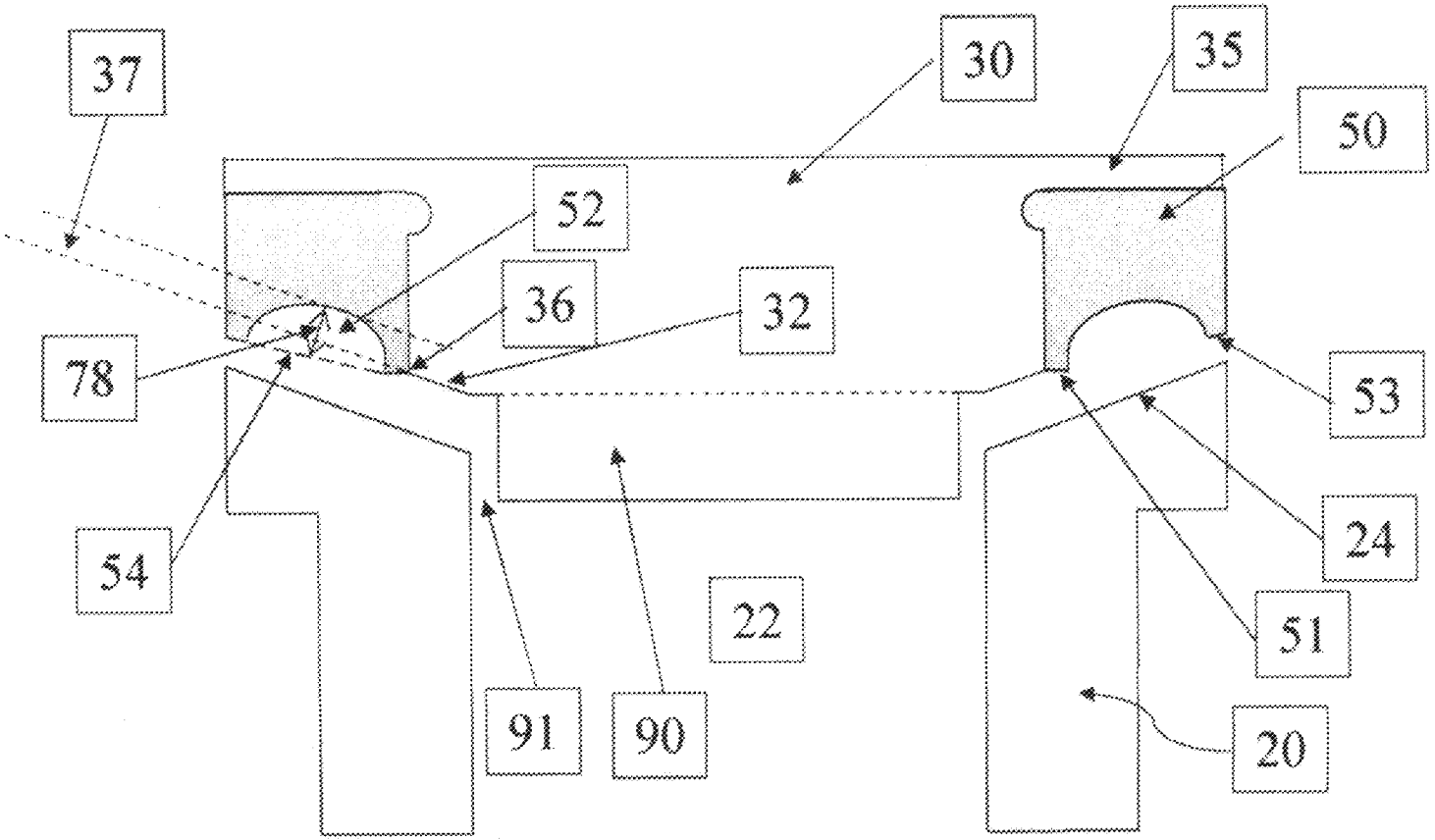

FIG. 29 illustrates a valve assembly comprising a cylindrical plug along with the reverse-pumping cavity between the valve insert and the valve seat. The radial gap between the outer radius of the cylindrical plug 90 and the inner radius of the valve seat member 20 should be larger than twice the diameter of the particles to be pumped, so that particles are not trapped by the gap, particularly during the valve lag period when slurry is in reverse flow through the valve apparatus. Volpin (U.S. Pat. No. 2,495,880) and McIntire (U.S. Pat. No. 6,701,955) describe plugs which can be used herein.

The cylindrical plug 90 in FIG. 29 improves the operation of the valve by delaying valve closure, and providing some valve lag. Without valve lag, the outer sealing surface 53 of the valve insert member 50 would approach the frustoconical surface 24 of the valve seat member 20 while slurry is pumped in the forward direction through the valve. After the sealing surface 53 reaches the distance from surface 24 at which proppant particles is screened out of the flowing slurry, proppant particles would be concentrated in slurry remaining in the cavity 52, under the inner sealing surface 51 and between the contact surfaces 32 and 24. Describing the situation for a discharge valve, it is preferable for the plunger to come to the end of its forward travel before the outer sealing surface 53 reaches that screening distance from surface 24. In such a preferred case, the valve is not closed when the plunger stops, and valve closure lags behind the plunger motion. Some slurry flow in reverse direction through the valve as it is closing is preferable to the valve closing to a particle screening height before the forward slurry flow ceases.

The valves are used at a variety of pump rates and with proppant particles of varying diameters. It is not possible to use a different valve spring for each pump rate and proppant diameter in order to tune the valve action and provide the desired amount of valve lag. However, the cylindrical plug 90 in FIG. 39 provides some valve lag for nearly all pump rates. As described in U.S. Pat. No. 6,701,955 B2, "Valve Apparatus" by McIntire et al., fluid forces due to the cylindrical plug 90 extending down into the throat 22 of the valve seat member 20 result in faster opening of the valve and higher lifting of the valve body 30 above the valve seat 20. Then, when the plunger is reaching the end of its forward travel and slurry flow through the valve is decreasing, fluid forces on the cylindrical plug hold valve body 30 above valve seat 20. Closure of the valve is delayed, and proppant particles are not screened from the slurry in forward flow direction.

After the plunger starts its suction stroke, the valve closes on slurry in reverse flow. The outer sealing surface 53 approaches the valve seat surface 24, and screens proppant particles from the slurry in reverse flow, providing a reverse flow of particle-free fluid into the cavity 52. Typical fracturing fluids are shear thinning, and particle free fluids are less viscous than slurries, so the particle-free fluid, entering the cavity in reverse flow before sealing surface 53 reaches the valve seat surface 24, can flow across the surface 24, bypassing the slurry in the cavity above. Particle-free fluid can flow through the cavity and into the strike face area before the valve closes and starts to pump fluid into the strike face area. This enhances the removal of proppant particles from the strike face area between the frustoconical surfaces 32 and 24 of the valve body 30 and the valve seat 20 respectively.

The elements of the valve assembly can be made from a variety of materials depending on design factors such as the type of fluid to be pumped and the pressure rating that is needed. The pump body portion 12 and the valve seat member 20 are usually made of metal. The valve closure member 30 is usually made of metal, but could also be made from composites or other durable materials in an effort to control the weight and balance of the valve closure member 30. The frustoconical contact surfaces 24 and 32 are typically made from a durable metal, while the resilient insert 50 is usually made from an elastomeric material such as a polyurethane. As discussed above, the performance of the present invention can be enhanced with the use of two or more different elastomeric materials (e.g., two different polyurethanes with appropriate properties) to make up the resilient insert 50.

The present invention can be practiced with various manufacturing techniques for the resilient insert member. The resilient insert member can be manufactured in place on the valve closure member, or can be manufactured independently and installed on the valve seat member.

The preceding description of specific embodiments of the present invention is not intended to be a complete list of every possible embodiment of the invention. Persons skilled in this field will recognize that modifications can be made to the specific embodiments described herein that would be within the scope of the present invention.

What is claimed is:

1. A novel valve apparatus having a longitudinal axis therethrough, comprising:

a valve seat member that comprises a hollow bore and a first frustoconical contact surface that has an inner perimeter and an outer perimeter;

a valve closure member that comprises a valve body and a second frustoconical contact surface that is adapted to seal against the first frustoconical contact surface in a strike face area, the valve closure member being movable along the longitudinal axis of the valve apparatus;

a fluid flow path through the bore of the valve seat member and between the valve seat member and the valve closure member, the fluid flow path being closed when the second frustoconical contact surface is in contact with the first frustoconical contact surface;

an elastomeric resilient valve insert member attached to the valve body member of the valve closure member, wherein said insert member:

(a) has an inner perimeter and an outer perimeter, the inner perimeter being adjacent the strike face area on the second frustoconical contact surface, (b) is offset and adapted to contact the first frustoconical contact surface and form a seal therewith at the outer perimeter of the insert member before the first frustoconical contact surface comes in contact with the second frustoconical surface as the valve closes, and wherein (i) the insert offset of the insert member is greater at its outer perimeter than at its inner perimeter, and (ii) the insert offset of the insert member is greater at its outer perimeter than the diameter of the largest particle in any fluid to be pumped though the bore of the valve seat member, (c) is deformable, but substantially non-compressible, and (d) comprises a particle retaining means to accommodate solid particles that are trapped between the insert member and the valve seat member when the valve closes, said particle retaining means having at least one cavity (void space) that is in fluid contact with the flow path for fluids between the valve seat member and the valve closure member when the valve is open, and wherein said cavity (i) has an opening in fluid contact with the flow path for fluids that is large enough for particles to pass through the opening and into the cavity, (ii) is large enough to accommodate one or more solid particles within the interior of the cavity, and wherein (iii) the volume of the cavity contracts as the valve closes, whereby slurry is forced out of the cavity into the flow path and whereby solid particles are screened from the fluid and retained within the cavity, and clear fluid is directed inwardly toward the hollow bore of the valve seat member over the surfaces of the first and second frustoconical contact surfaces.

2. The valve apparatus defined in claim 1 wherein said insert has a tapered offset.

3. The valve apparatus defined in claim 1 wherein said insert has a constant offset.

4. The valve apparatus defined in claim 1 wherein the cavity in said particle retaining means is symmetrically disposed within the insert about the longitudinal axis.

5. The valve apparatus defined in claim 4 wherein said particle retaining means has a single cavity.

6. The valve apparatus defined in claim 4 wherein said particle retaining means has a plurality of cavities.

7. The valve apparatus defined in claim 1 wherein said cavity has a generally curved surface, in cross-section.

8. The valve apparatus defined in claim 7 wherein said cavity has a generally semi-circular, parabolic or U-shaped surface, in cross-section.

9. The valve apparatus defined in claim 5 wherein said particle retaining means has a generally curved surface, in cross-section.

10. The valve apparatus defined in claim 9 wherein said cavity has a generally semi-circular, parabolic or U-shaped surface, in cross-section.

11. The valve apparatus defined in claim 1 wherein said particle retaining means has a plurality of cavities randomly disposed about the surface of the insert member that are in fluid contact with the fluid flow path, each of said cavities having a generally circular opening to said fluid flow path and having a generally curved surface, in cross-section.

12. The valve apparatus defined in claim 11 wherein each of said cavities has a generally semi-circular, parabolic or U-shaped surface, in cross-section.

13. The valve apparatus defined in claim 11 wherein said insert has a tapered offset.

14. The valve apparatus defined in claim 1 wherein the cavity of said particle retaining means is within the insert member or the valve seat member or both.

15. The valve apparatus defined in claim 1 wherein the cavity of said particle retaining means is within the insert member.

16. The valve apparatus defined in claim 5 wherein the cavity of said particle retaining means is within the insert member.

17. The valve apparatus defined in claim 9 wherein the cavity of said particle retaining means is within the insert member.

18. The valve apparatus defined in claim 1 wherein the top diameter of the valve closure member is approximately the same as the diameter of the valve insert member.

19. The valve apparatus defined in claim 1 wherein the top diameter of the valve closure member is less than the diameter of the valve insert member, thereby permitting the insert member to flex upward when the valve closes.

20. The valve apparatus defined in claim 17 wherein the opening of the cavity in the particle retaining means is at least about 2 times the diameter of the largest particle trapped between the insert member and the valve seat member.

21. The valve apparatus defined in claim 1 wherein said valve body additionally comprises a lifting plug attached thereto which extends into the hollow bore of the valve seat member when the valve is closed.

22. The valve apparatus defined in claim 5 wherein the cavity depth is greater than the maximum insert offset.

23. The valve apparatus defined in claim 22 wherein the cavity depth is greater than the sum of the insert offset plus about 0.08 inches.

24. The valve apparatus defined in claim 5 wherein the depth of the cavity is at least about 0.033 inches, the maximum diameter of particles that will pass through a US Standard 20 mesh screen.

25. The valve apparatus defined in claim 5 wherein the depth of the cavity is at least about 0.08 inches, the maximum diameter of particles that will pass through a US Standard 10 mesh screen.

26. A valve apparatus having a longitudinal axis therethrough, comprising:

a valve seat member that comprises a hollow bore and a first frustoconical contact surface;

a valve closure member that comprises a body and a second frustoconical contact surface that is adapted to seal against the first frustoconical contact surface, the valve closure member being movable along the longitudinal axis of the valve apparatus;

a fluid flow path through the bore of the valve seat member and between the valve seat member and the valve closure member, the fluid flow path being closed when the second frustoconical contact surface is in contact with the first frustoconical contact surface;

an elastomeric valve insert member attached to the valve body member; and a means to accommodate solid particles trapped between the insert member and the valve seat member when the valve closes, without deforming the insert member more than when the valve closes without the presence of particles.

27. A valve apparatus having a longitudinal axis therethrough, comprising:

a valve seat member that comprises a hollow bore and a first frustoconical contact surface that has an inner perimeter and an outer perimeter;

a valve closure member that comprises a valve body and a second frustoconical contact surface that is adapted to seal against the first frustoconical contact surface in a strike face area, the valve closure member being movable along the longitudinal axis of the valve apparatus;

a fluid flow path through the bore of the valve seat member and between the valve seat member and the valve closure member, the fluid flow path being closed when the second frustoconical contact surface is in contact with the first frustoconical contact surface;

an elastomeric valve insert member attached to the valve body member; and a means to pump fluid from a cavity or cavities in said insert member in reverse flow inwardly toward the hollow bore and over the strike face area between the first frustoconical contact surface and the second frustoconical contact surface as the valve closes.

28. A valve apparatus having a longitudinal axis therethrough, comprising:

a valve seat member that comprises a hollow bore and a first frustoconical contact surface that has an inner perimeter and an outer perimeter;

a valve closure member that comprises a valve body and a second frustoconical contact surface that is adapted to seal against the first frustoconical contact surface in a strike face area, the valve closure member being movable along the longitudinal axis of the valve apparatus;

a fluid flow path through the bore of the valve seat member and between the valve seat member and the valve closure member, the fluid flow path being closed when the second frustoconical contact surface is in contact with the first frustoconical contact surface;

an elastomeric valve insert member attached to the valve body member; and a means to pump fluid from a cavity or cavities in said insert member, and to screen out any particles contained in said fluid, to thereby provide a reverse flow of clear fluid directed inwardly toward the hollow bore and over the strike face area between the first frustoconical contact surface and the second frustoconical contact surface as the valve closes.

* * * * *